US008104501B1

(12) United States Patent
Ness

(10) Patent No.: US 8,104,501 B1
(45) Date of Patent: Jan. 31, 2012

(54) FLUID HANDLING SYSTEM

(76) Inventor: Daniel W. Ness, Metairie, LA (US)

( * ) Notice: Subject to any disclaimer, the term of this patent is extended or adjusted under 35 U.S.C. 154(b) by 479 days.

(21) Appl. No.: 12/398,791

(22) Filed: Mar. 5, 2009

Related U.S. Application Data

(60) Provisional application No. 61/033,926, filed on Mar. 5, 2008.

(51) Int. Cl.
*F17D 1/08* (2006.01)
*E21B 21/01* (2006.01)

(52) U.S. Cl. ..... 137/259; 137/266

(58) Field of Classification Search ..... 137/259, 137/266, 255
See application file for complete search history.

(56) References Cited

U.S. PATENT DOCUMENTS

| | | | | |
|---|---|---|---|---|
| 1,705,649 | A | | 3/1929 | Scott |
| 2,506,412 | A | | 5/1950 | Chausse |
| 2,566,873 | A | | 9/1951 | Britton |
| 2,683,010 | A | | 7/1954 | Hamerslag, Jr. |
| 3,323,538 | A | * | 6/1967 | Chaney ..... 137/259 |
| 3,916,803 | A | | 11/1975 | Garcia |
| 4,165,806 | A | | 8/1979 | Cayton |
| 4,553,880 | A | * | 11/1985 | Byrd et al. ..... 406/23 |
| 4,828,311 | A | | 5/1989 | Hayashi |
| 5,156,233 | A | | 10/1992 | Olsen et al. |
| 5,267,792 | A | | 12/1993 | Schlake |
| 5,292,012 | A | | 3/1994 | Davis et al. |
| 5,507,237 | A | | 4/1996 | Barrow et al. |
| 6,112,760 | A | | 9/2000 | Scott et al. |
| 6,357,365 | B1 | | 3/2002 | Higgins et al. |
| 6,371,299 | B1 | | 4/2002 | Essary |
| 6,915,815 | B1 | | 7/2005 | Ness |

* cited by examiner

*Primary Examiner* — Kevin Lee
(74) *Attorney, Agent, or Firm* — Garvey, Smith, Nehrbass & North, L.L.C.; Charles C. Garvey, Jr.; Vanessa M. D'Souza

(57) ABSTRACT

A method and apparatus for handling fluids on an oil and gas well drilling platform utilizes detachable peripheral frames to reduce the per square foot load transferred to the platform when reservoirs on the apparatus are filled to (or near) capacity.

23 Claims, 24 Drawing Sheets

FLUID HANDLING SYSTEM

CROSS-REFERENCE TO RELATED APPLICATIONS

Priority of U.S. Provisional Patent Application Ser. No. 61/033,926, filed Mar. 5, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the handling of oil and gas well drilling fluids, especially in an offshore or marine environment. More particularly, the present invention relates to an improved oil and gas well fluids transfer apparatus that features a first module carrying multiple supply reservoirs for holding different drilling or production fluids and a second, typically smaller supply module for holding one or more resupply modules and wherein a docking station interfaces the two modules, fluid transfer being effected with specially configured piping so that any one reservoir can be filled with a selected resupply reservoir that is docked on the docking station; and wherein a detachable perimeter frame or frames enables load to be transferred to a larger area when all reservoirs are filled or to be filled.

2. General Background of the Invention

In the drilling of oil and gas wells, a large number of different fluids are typically employed. These fluids can include various chemical formula that assist the driller. These fluids can include, for example, drilling mud, surfactance, brine solutions, thickening solutions, other oil well drilling or completions fluids and the like. In coastal, or other offshore marine environment, the drilling of oil and gas wells employs a platform that can be floating, semi-submersible, fixed, tension leg, spar or the like. Such coastal, offshore or marine oil platforms are well known in the art.

An offshore marine platform typically suffers from lack of space. These special constraints are due to the enormous expense of constructing offshore drilling platforms. A huge array of equipment is needed for the drilling and operation of oil and gas wells. Constant supply and resupply that is an ongoing procedure. Huge work boats carry drill pipe, equipment, personnel, food, drilling fluids, completion fluids, and other material to the offshore platform. Unloading and placement of these supplies is an enormous problem.

In the handling of fluids, huge volumes (with huge weight) can be required, and after they are expended, the tank or other vessel that carried the fluid must quickly be moved from the rig floor to make room for the others.

Over the years, 55 gallon drums and other like disposable containers have been used to transfer drilling and other fluids to and from an oil and gas well drilling rig. These drums and like containers create a huge storage problem for the rig operators.

U.S. Pat. No. 6,915,815 issued Jul. 12, 2005 to Ness for a fluids management system, that patent being hereby incorporated herein by reference.

BRIEF SUMMARY OF THE INVENTION

The present invention provides an improved fluids transfer system that enables a rig operator to efficiently and quickly transfer fluids during normal course of operation of the offshore oil well drilling or production platform.

The present invention provides an efficient and novel system, including a method and apparatus for transferring drilling fluids to an offshore oil and gas well drilling platform and for fluid transfer once on the platform.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
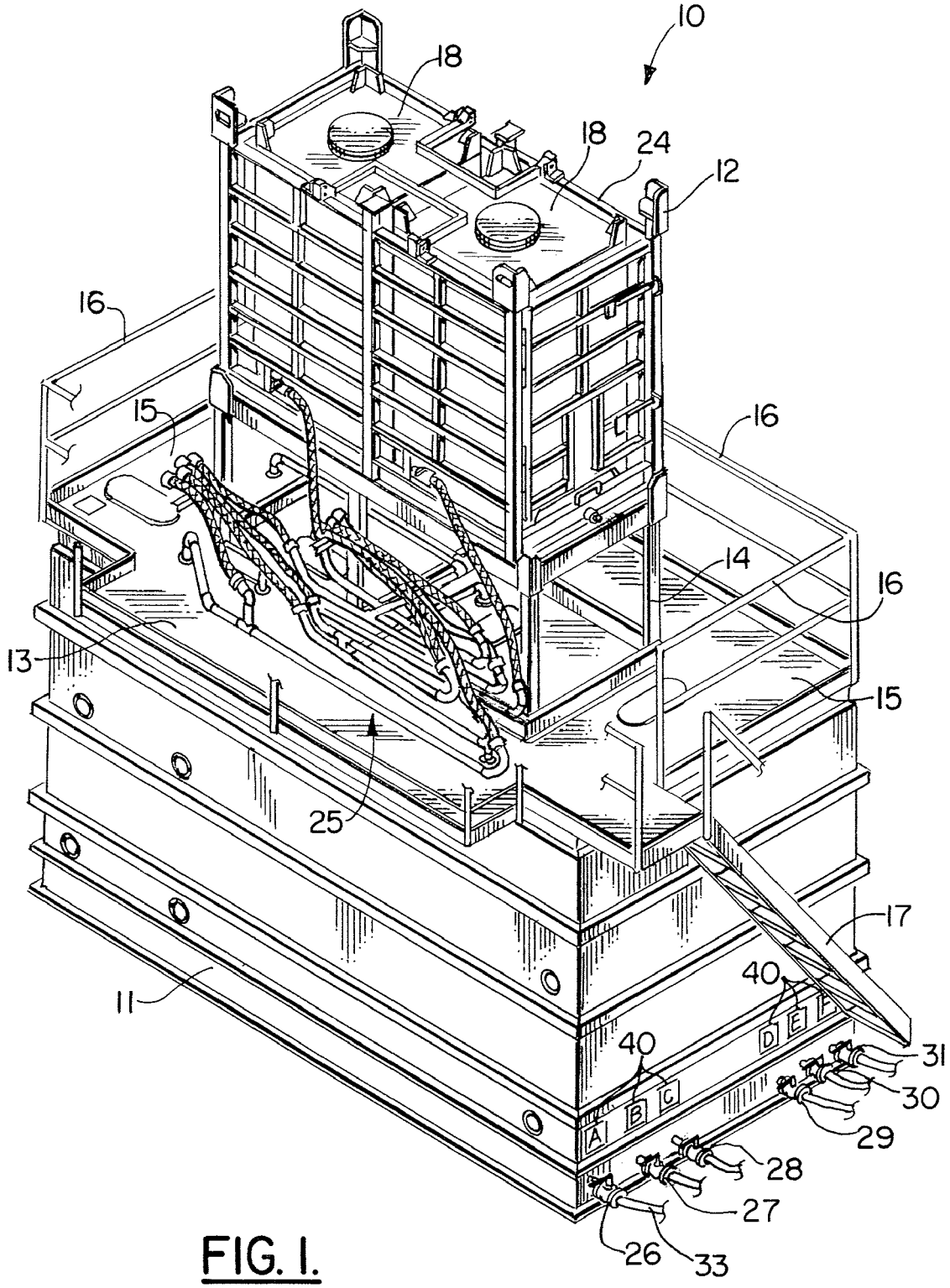
FIG. 1 is a perspective view of the preferred embodiment of the apparatus of the present invention.
Figure 2:
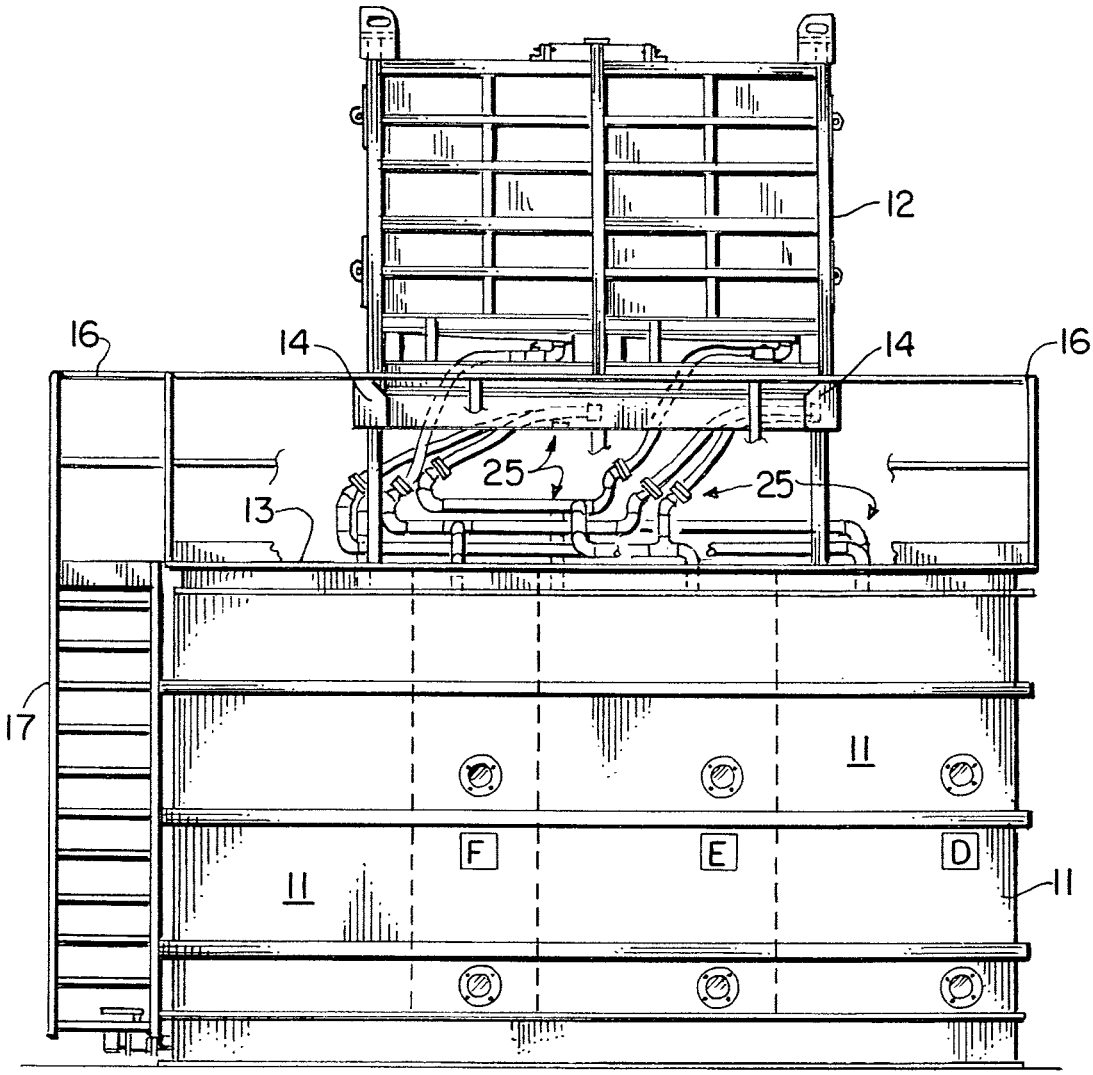
FIG. 2 is an elevation view of the preferred embodiment of the apparatus of the present invention.
Figure 3:
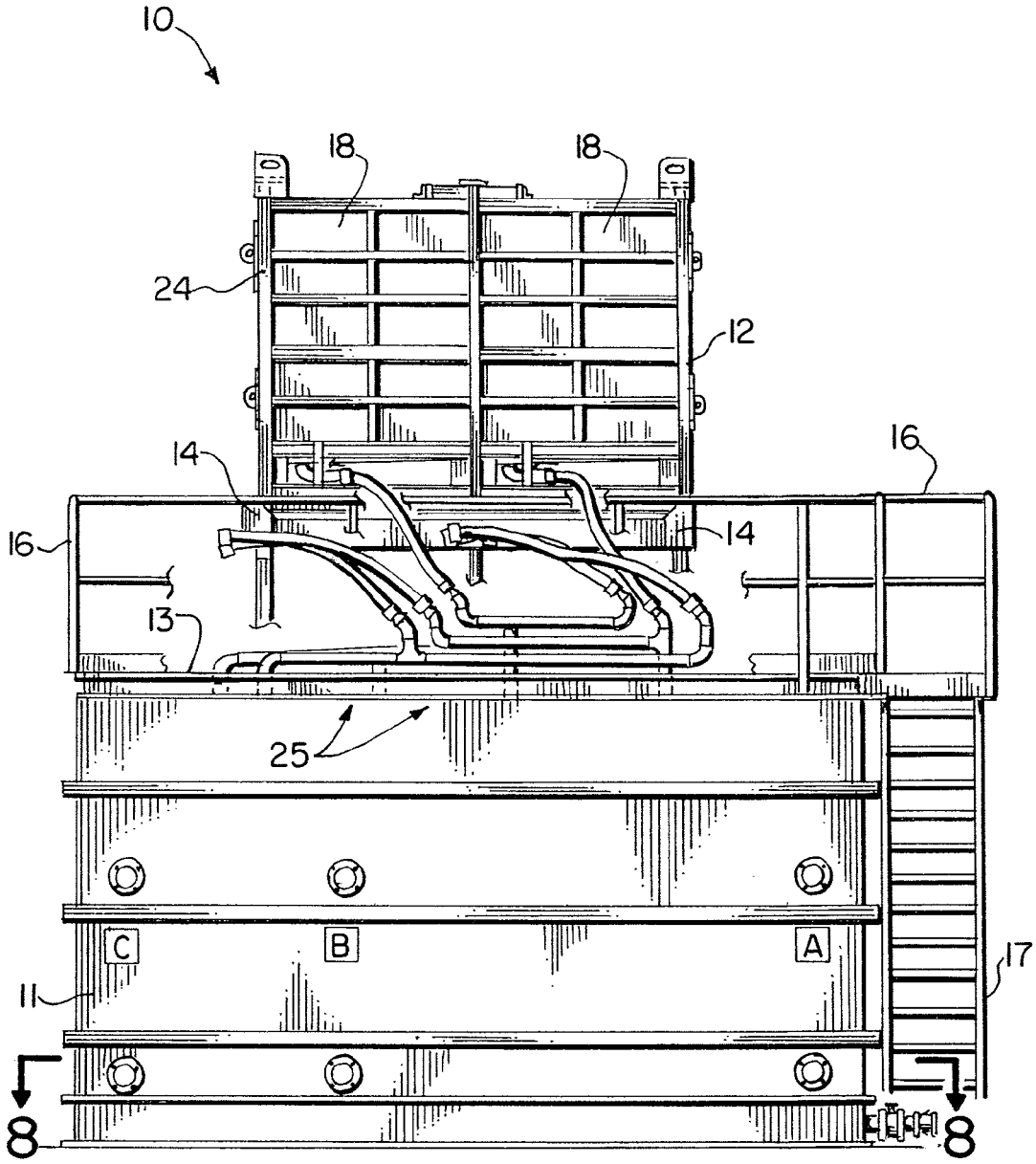
FIG. 3 is another elevation view of the preferred embodiment of the apparatus of the present invention.
Figure 4:
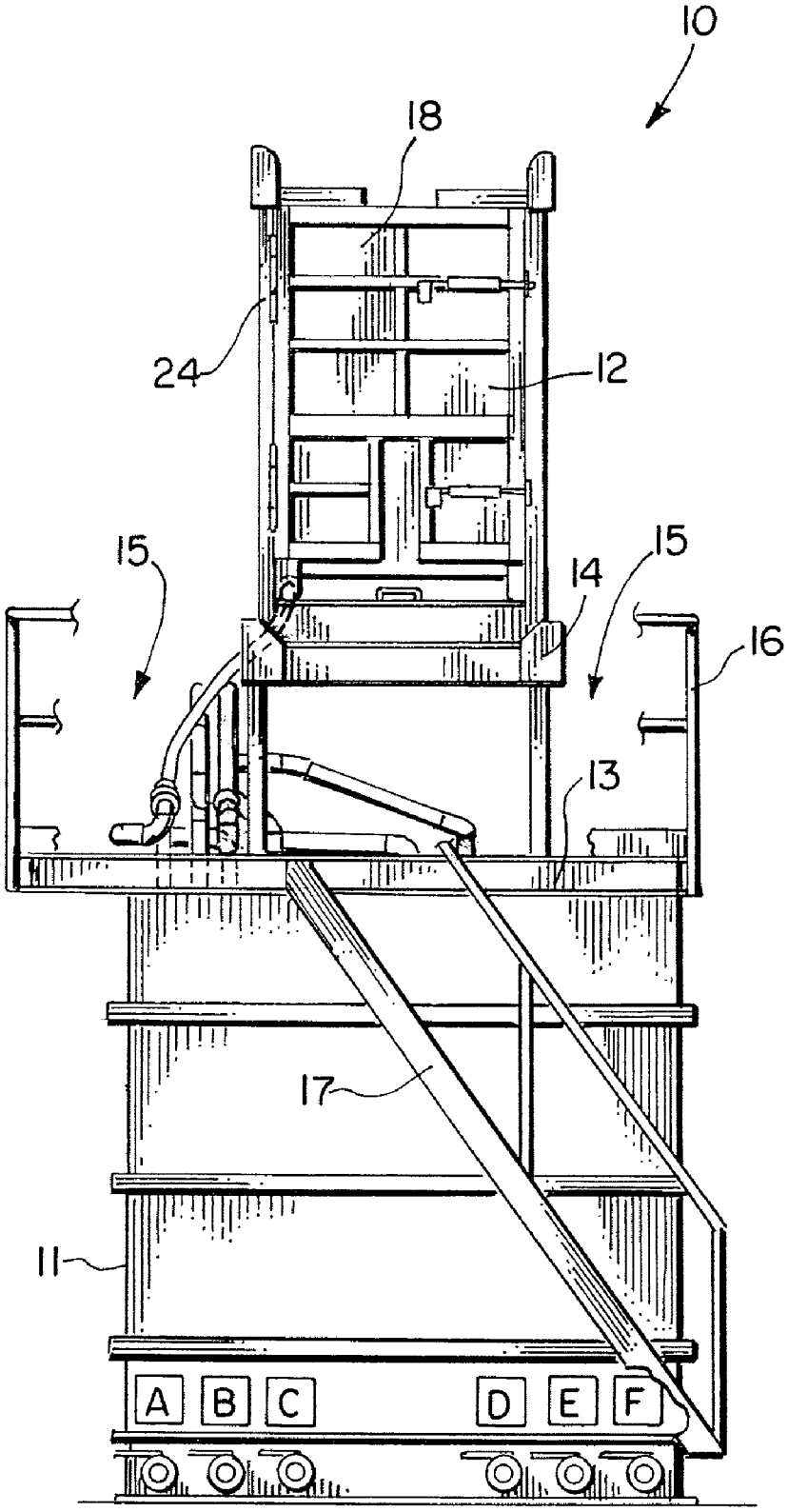
FIG. 4 is a side view of the preferred embodiment of the apparatus of the present invention.
Figures 5, 6:
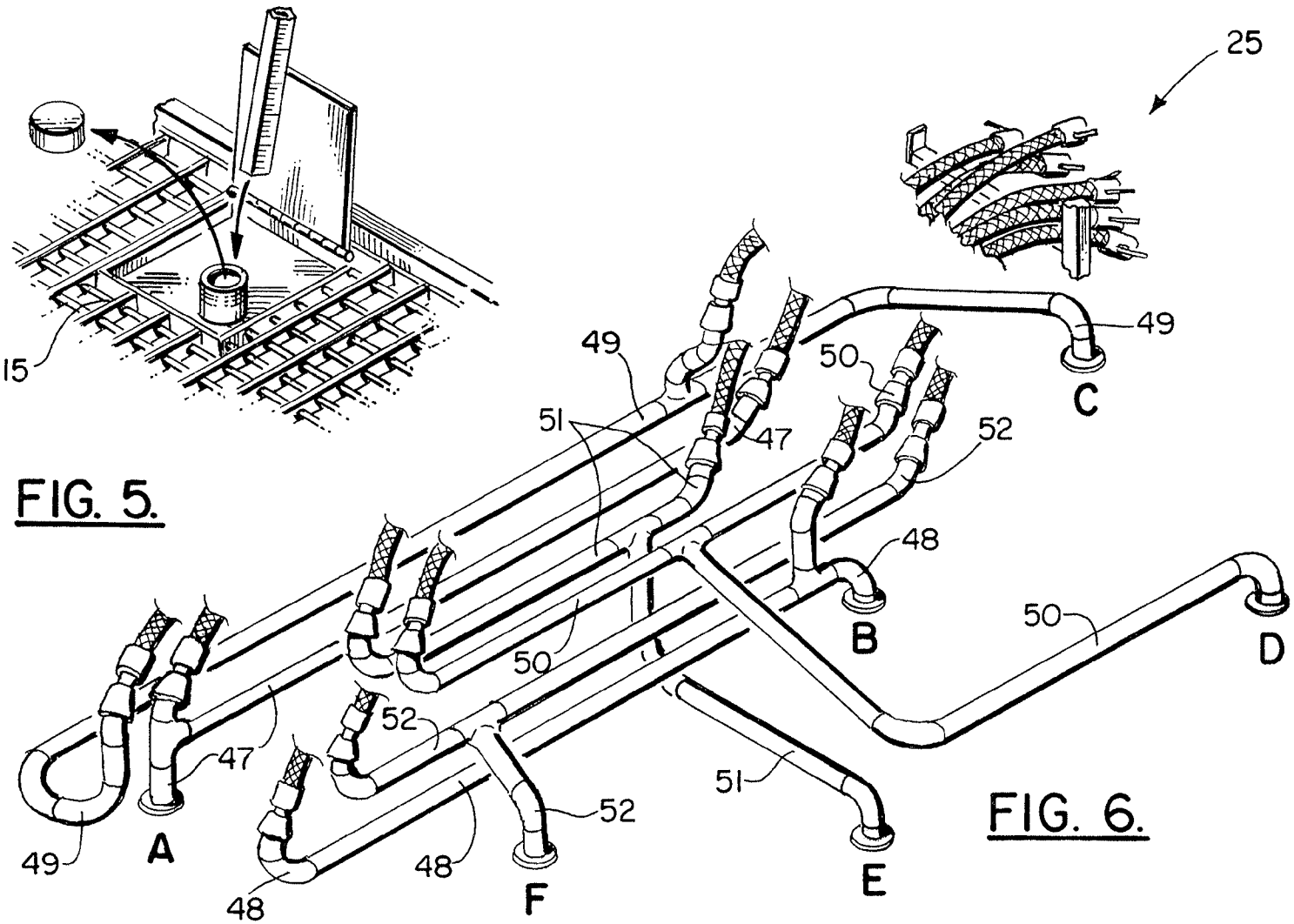
FIG. 5 is a fragmentary perspective view of the preferred embodiment of the apparatus of the present invention.
FIG. 6 is a fragmentary perspective view of the preferred embodiment of the apparatus of the present invention illustrating the piping system.

FIGS. 1-4 show generally the preferred embodiment of the apparatus of the present invention, designated generally by the numeral 10 in FIGS. 1-4. Fluids management apparatus 10 includes a lower module or storage reservoir 11 and an upper module or resupply reservoir 12.

The lower module or storage reservoir 11 has a platform deck 13 that carries docking station 14. The docking station 14 can be centrally located upon platform 13 to provide a deck or walkway 15 that extends along one or more sides of the docking station 14. Walkway 15 can be provided with suitable railing 16 for protecting workers that ascend stairway 17 to gain access to platform deck 13 and walkway 15.

Figure 12:
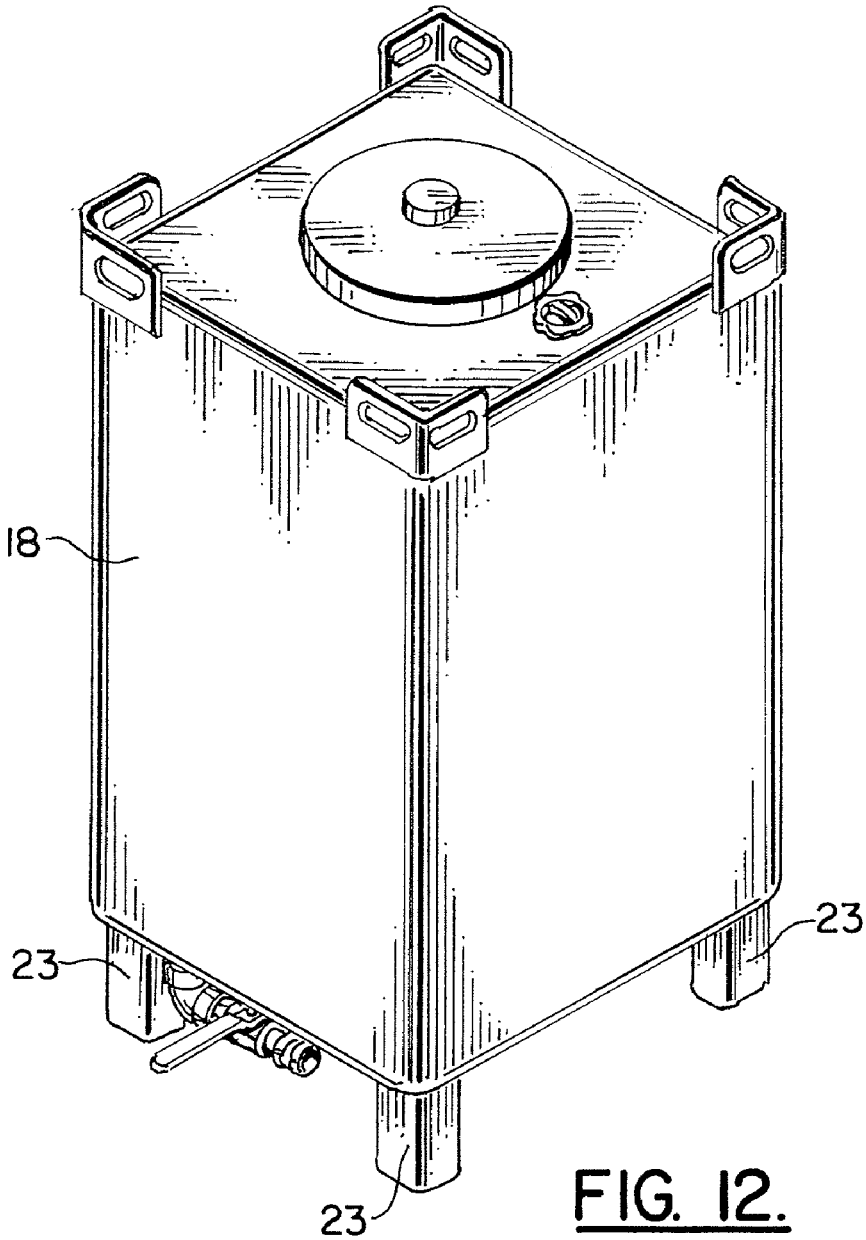
FIG. 12 is a partial perspective view of the preferred embodiment of the apparatus of the present invention illustrating one of the resupply tanks.
Figure 13:
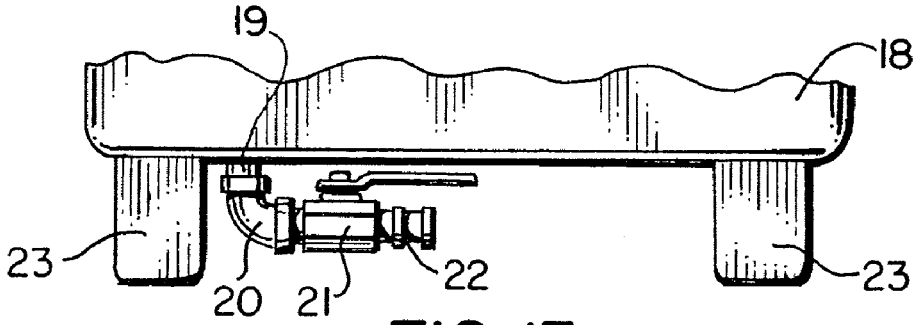
FIG. 13 is a fragmentary elevation view of resupply tank of FIG. 13.

The upper module or resupply reservoir 12 can be a liftable structure that can be lifted using a crane or other lifting device so that it can be removed from or placed upon docking station 14. This upper module or resupply reservoir 12 is provided with one or more resupply tanks 18. Each tank 18 (see FIGS. 12-13) is a fluid containing vessel that has a lower end portion with flow outlet 19. A piping spool piece 20 is connected to flow outlet 19 (for example, welded thereto) and can include valve 21 for controlling fluid flow from tank 18 during use. In addition to valve 21, spool piece 20 can be provided with hose coupling fitting 22 or other suitable outlet fitting so that the combination of valve 21 and hose coupling (or other fitting) 22 enables fluid to be discharged from tank 18 as needed. Tank 18 can be provided with a plurality of feet 23 that space the fluid containing portion of tank 18 above an underlying support surface to provide clearance for the attachment of spool piece 20, valve 21 and hose coupling fitting 22 to flow outlet 19.

Tank 18 can be of welded steel construction such as stainless steel, for example. Tank 18 can be of any suitable fluid containing material that is compatible with the various oil and gas well drilling fluids that will be transported to the lower module or resupply reservoir 12. Spool piece 20, valve 21 and hose coupling fitting 22 are commercially available pipe, valve, and fitting items.

In FIGS. 1-4 resupply reservoir 12 has a reservoir frame 24 that is configured to hold one or more resupply tanks 18, a pair of tanks 18 being shown contained within reservoir frame 24 in FIGS. 1-4. In an alternate embodiment (FIGS. 13-23), four resupply tanks are provided. The particular construction of reservoir frame 24 can be seen in co-pending U.S. patent application Ser. No. 10/356,706, filed on Jan. 31, 2003 and incorporate herein by reference.

A piping system 25 (see FIGS. 1-4, 6, 7, and 8) is provided for transferring fluids from a selected tank 18 of resupply reservoir 12 to a selected storage tank 34-39 that is a part of storage reservoir 11. The piping system 25 thus provides piping and hoses that are connectable to a selected tank 18 of resupply reservoir 12 and enable a transfer of fluid to a selected one of the tanks 34-39.

In the drawings, the letters A, B, C, D, E, F are used to designate six different fluids that can be handled using the fluids management apparatus 10 and method of the present invention. In FIG. 1, these different fluid designations A, B, C, D, E, F can be seen as labels 40, placed upon the wall of storage reservoir 11 above respective storage reservoir outlets 26, 27, 28, 29, 30, 31. During use, these labels 40 could be numbers, letters, or the actual names of the chemicals to be transferred.

In the drawings, the letters A, B, C, D, E, F have been placed in the appropriate location on each of the figures to indicate the particular chemical contained within a particular storage tank 34-39. These letters A, B, C, D, E, F have also been used to mark the different manifolds, pipes and hoses that transfer the selected chemical that is represented by the letter A, B, C, D, E, or F. Following are exemplary chemicals that could be handled using the method and apparatus of the present invention.

Figure 7:
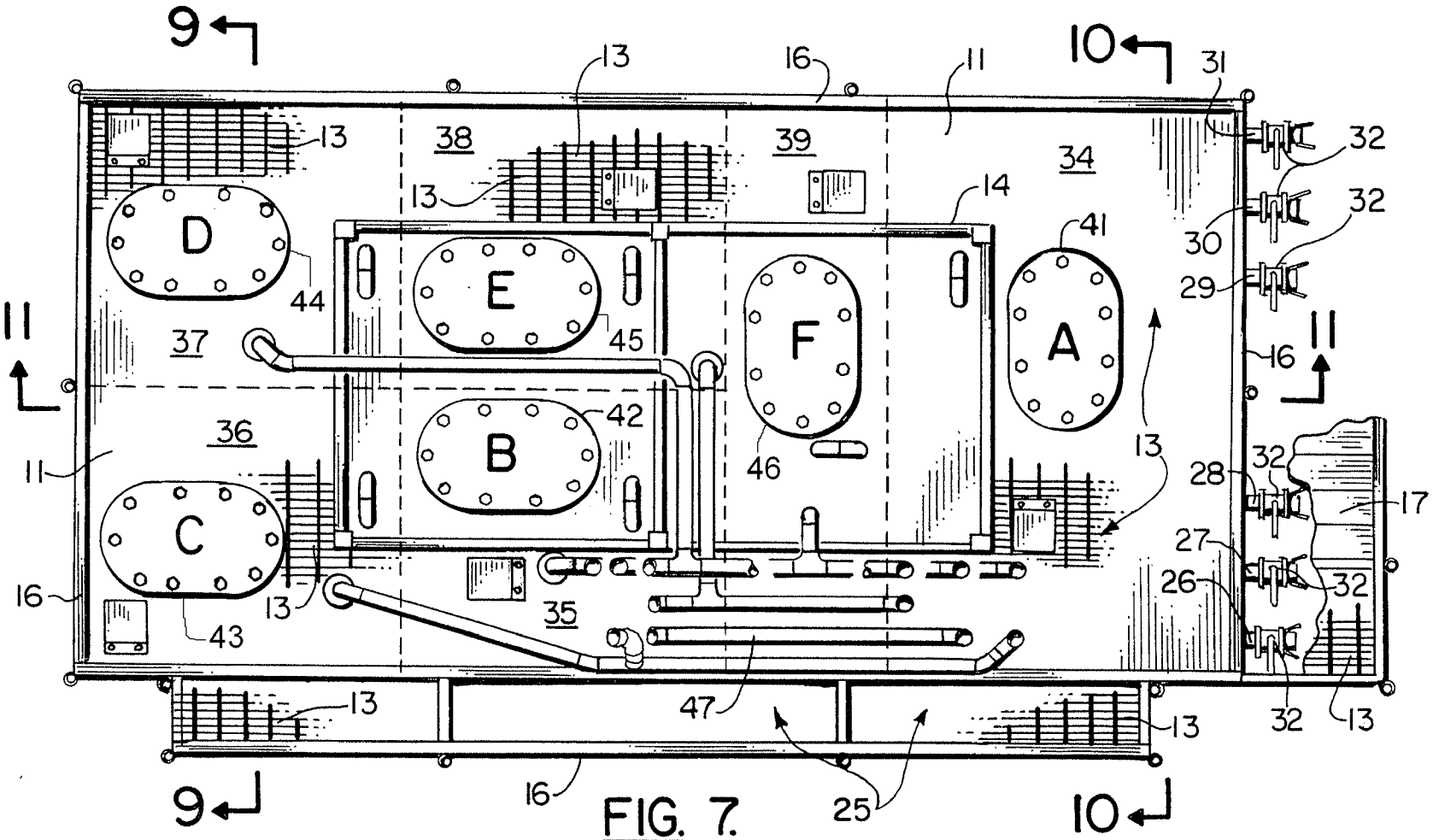
FIG. 7 is a plan view of the lower module of the preferred embodiment of the apparatus of the present invention.
Figure 8:
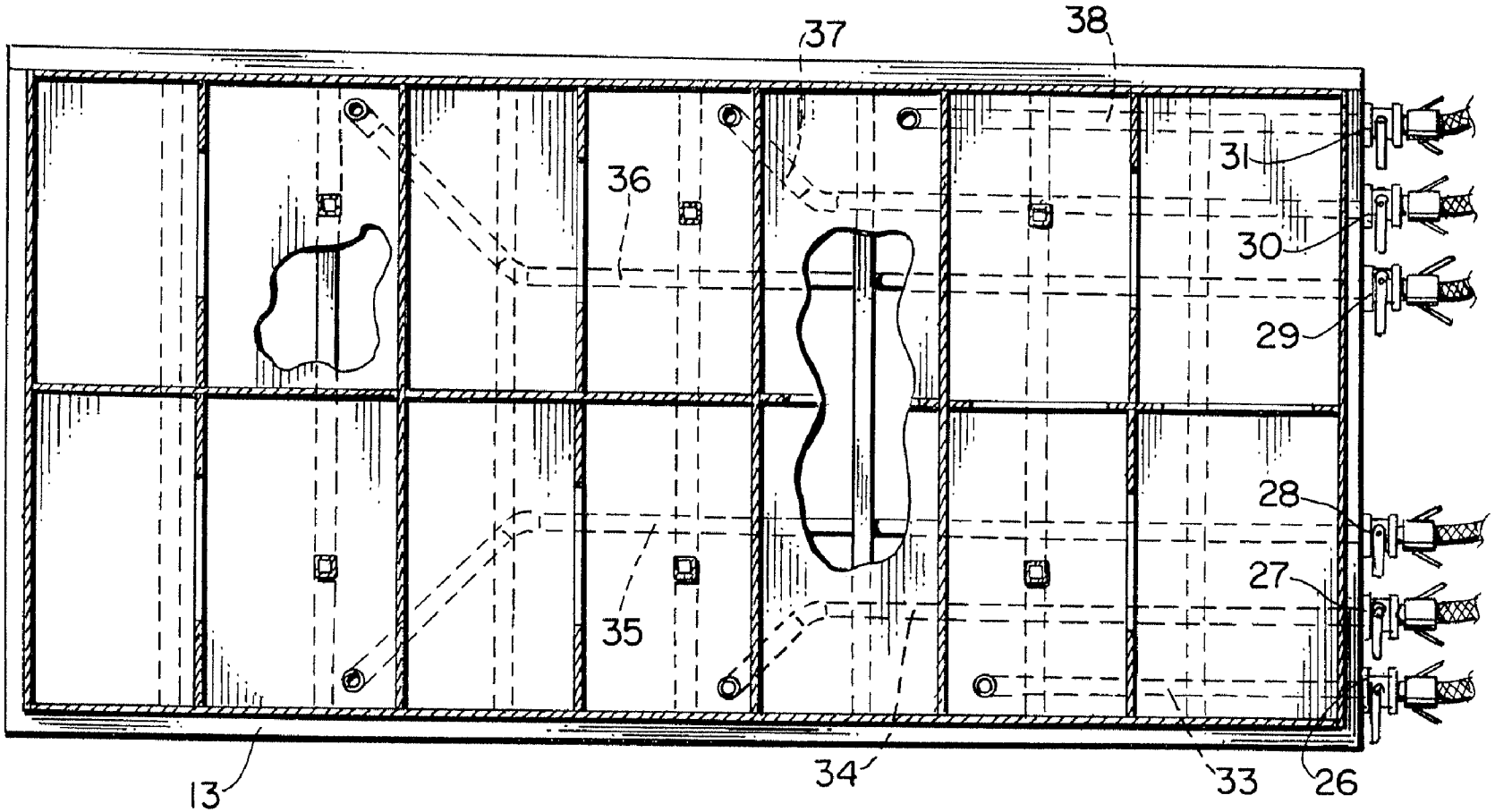
FIG. 8 is a sectional view taken along lines 8-8 of FIG. 3.
Figure 10:
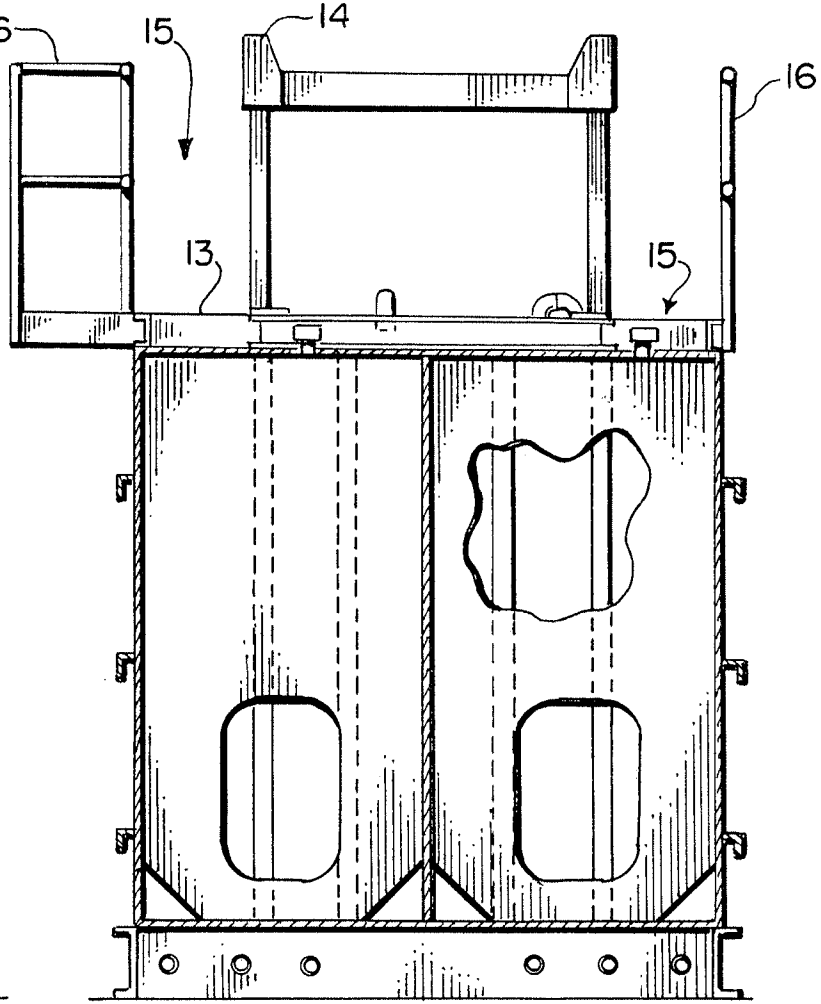
FIG. 10 is a sectional view taken along lines 10-10 of FIG. 7.
Figure 9:
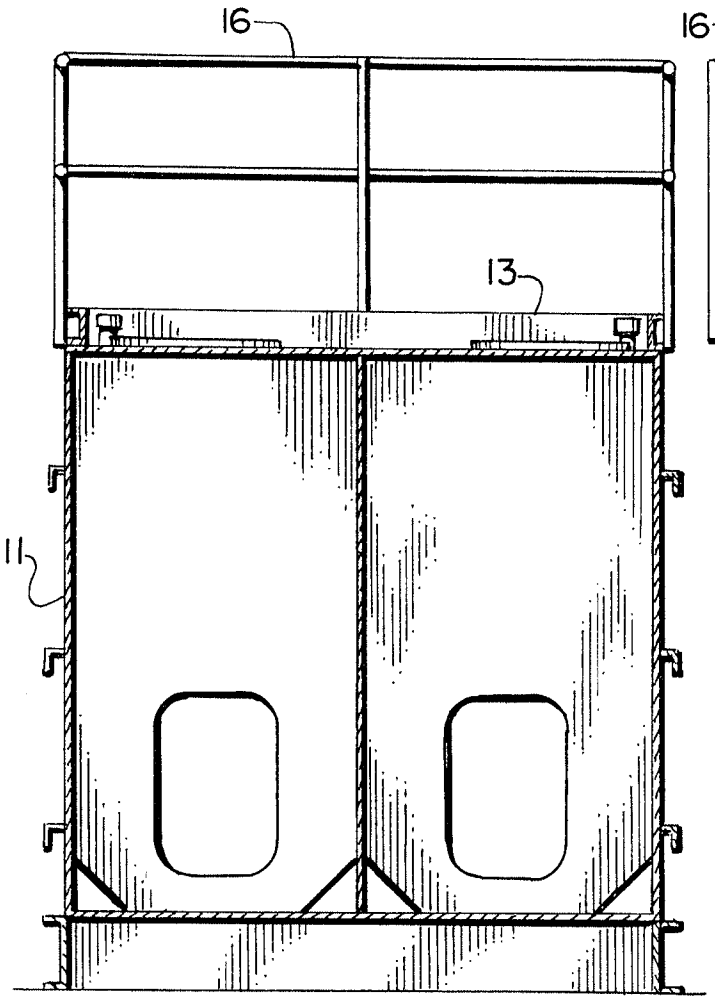
FIG. 9 is a sectional view taken along lines 9-9 of FIG. 7.
Figure 11:
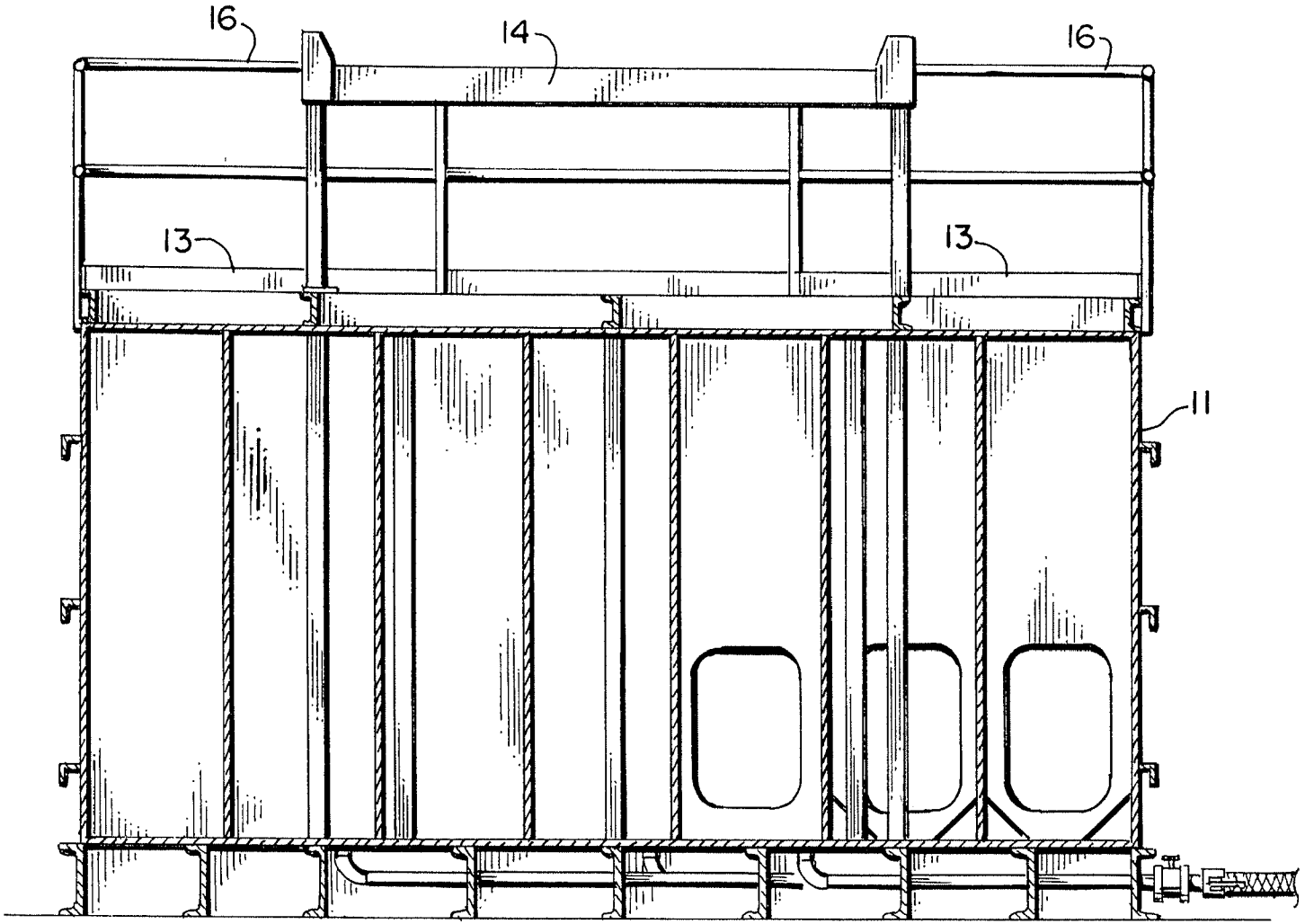
FIG. 11 is a sectional view taken along lines 11-11 of FIG. 7.

Each of the storage reservoir outlets 26-31 is provided with a discharge valve 32 and a discharge flow line 33 that can be of any selected length and that can be used to transmit the selected fluid A, B, C, D, E or F to any location on the platform during drilling operations. In FIG. 7, the storage reservoir or lower module 11 can be seen subdivided (as shown by dotted lines) into six different storage tanks 34, 35, 36, 37, 38, 39. The letters A, B, C, D, E, F in FIG. 7 are placed upon a man-way for each storage tank. Such man-ways enable the tank interiors to be accessed for inspection, cleaning, maintenance and the like. The largest tank 34 has man-way 41 that bears the letter A for the chemical A that is contained within tank 34. Likewise, the tank 35 has a man-way 42 that bears the letter B indicating that a chemical B is contained within tank 35.

The additional tanks 36, 37, 38, 39 provide man-ways 43, 44, 45, 46 respectively, each labeled with a letter representing the chemical that is contained within that particular storage tank 36, 37, 38, or 39. The piping system 25 includes flow lines for enabling a selected fluid to be transmitted from any one of the resupply tanks 18 to any one of the storage tanks 34-39. For example, flow line 47 is a flow line that is provided on deck 13 for transmitting fluid from a selected tank 18 to the first storage tank 34. Flow line 48 can be used to transmit fluids from a selected resupply tank 18 to tank 35. Likewise, flow line 49 transfers fluid from a selected resupply tank 18 to tank 36. Flow line 50 transfers fluid from a selected resupply tank 18 to tank 37. Flow line 51 transfers fluid from a selected resupply tank 18 to tank 38. Flow line 52 transfers fluid from a selected resupply tank 18 to tank 39.

Figure 14:
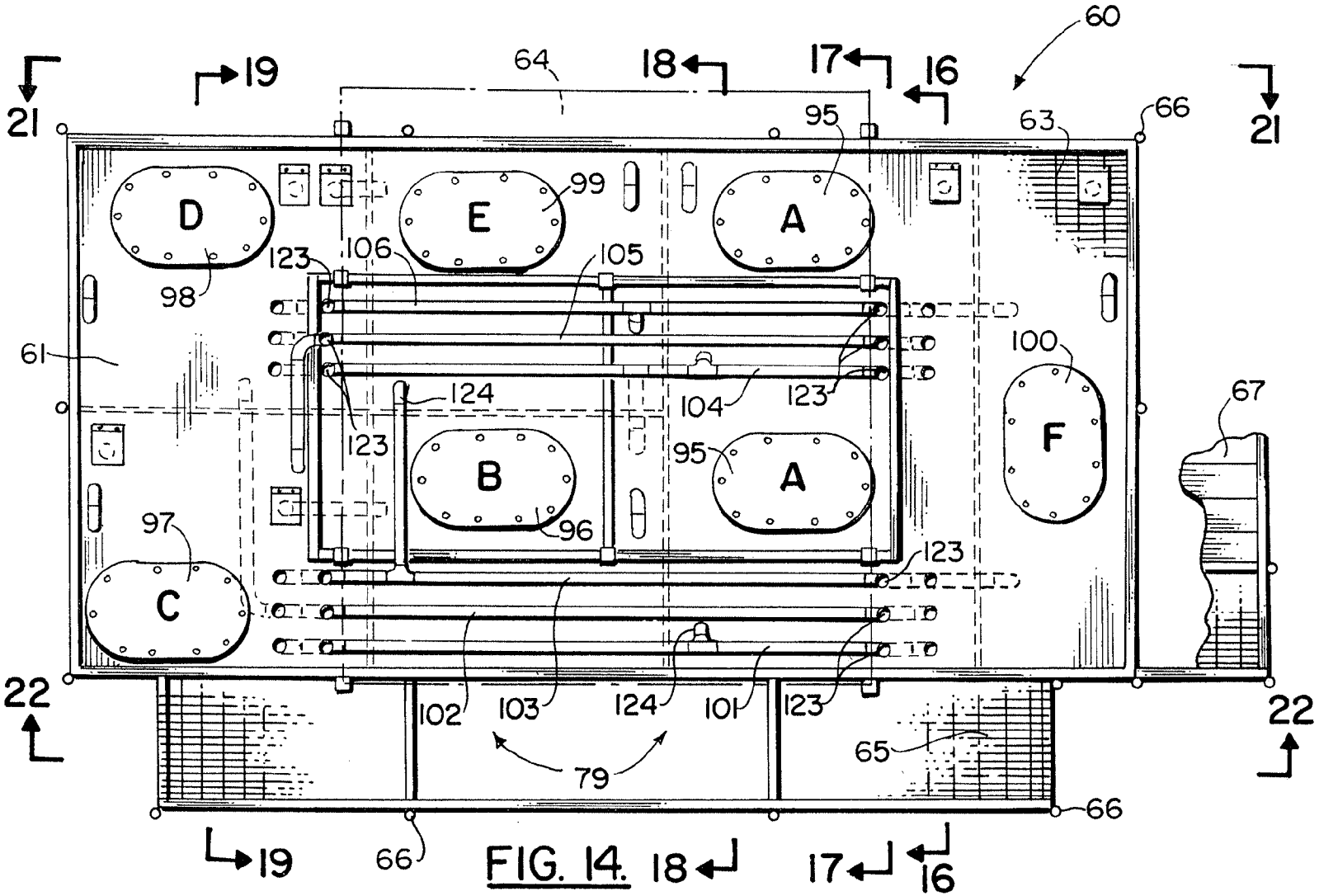
FIG. 14 is a plan view of a second embodiment of the apparatus of the present invention.
Figure 15:
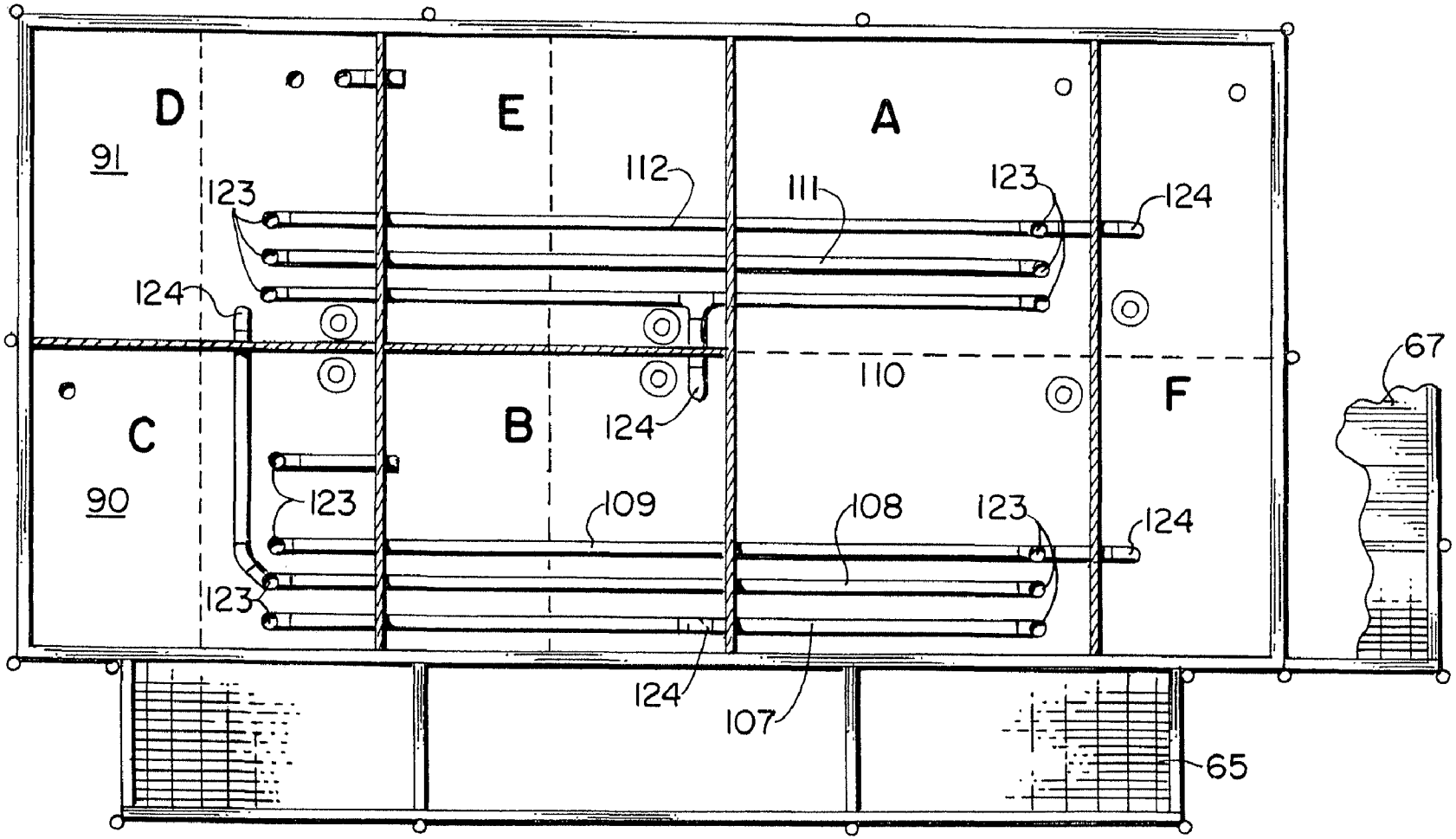
FIG. 15 is partial plan view of the second embodiment of the apparatus of the present invention.
Figure 16:
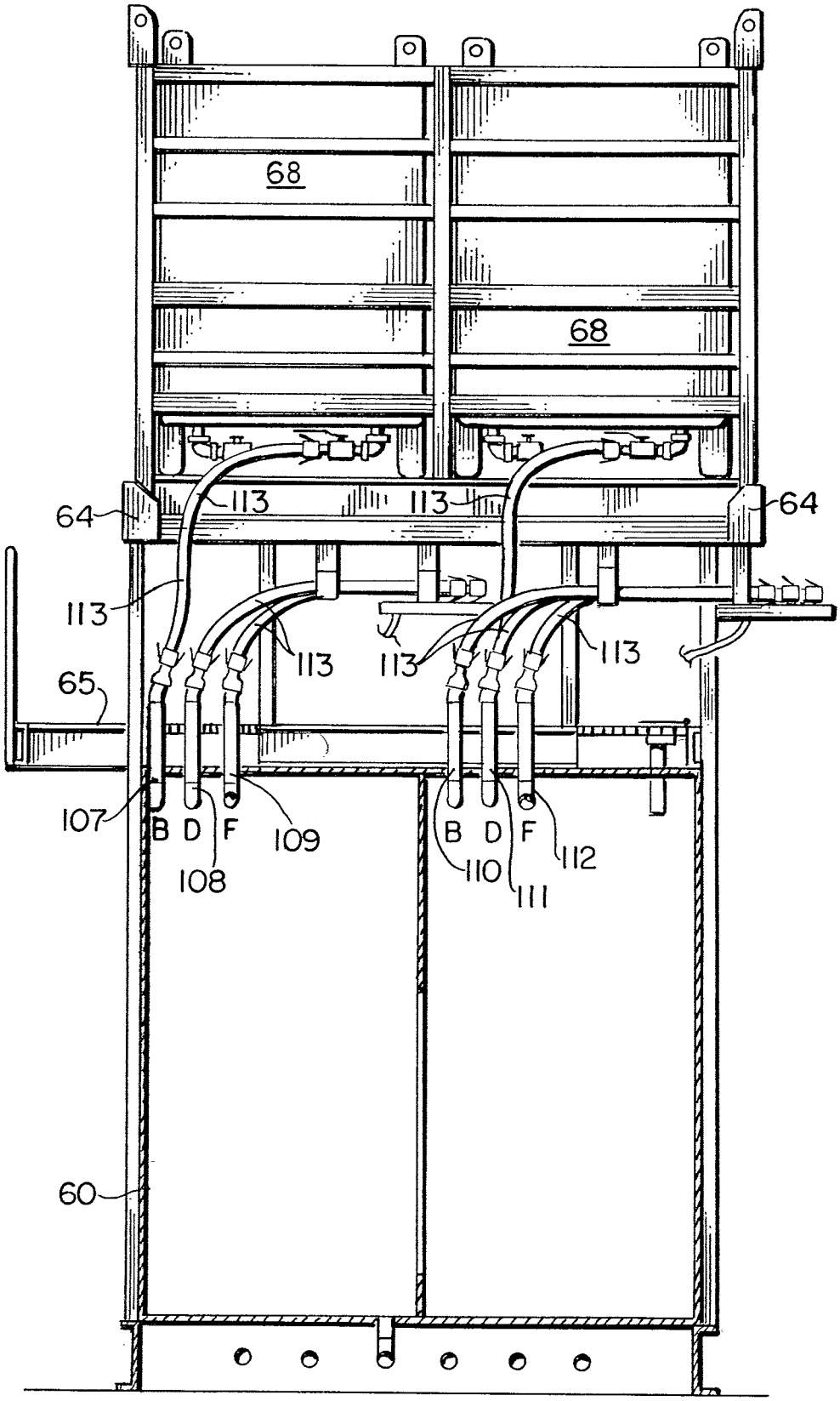
FIG. 16 is a sectional view taken along lines 16-16 of FIG. 14.
Figure 17:
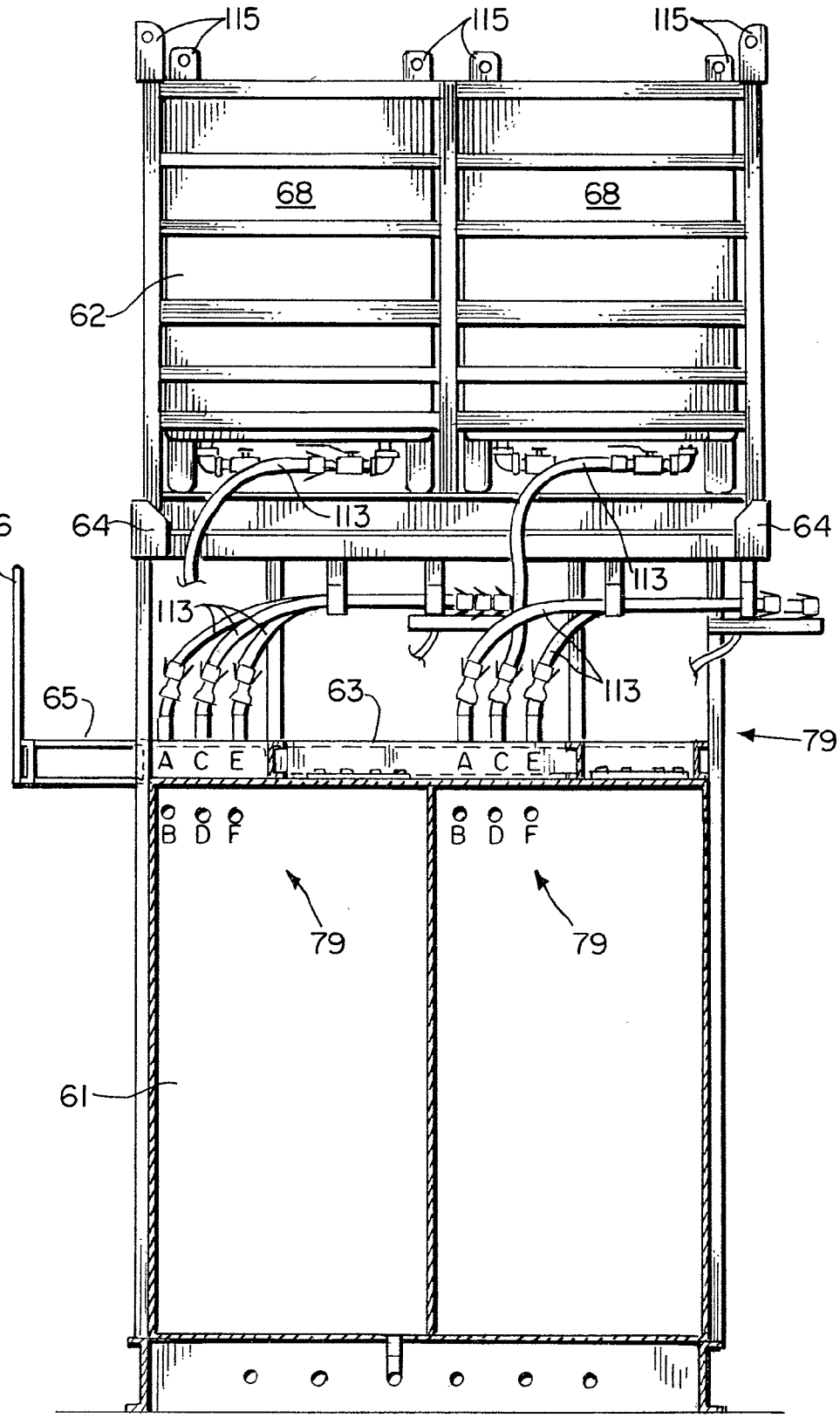
FIG. 17 is a sectional view taken along lines 17-17 of FIG. 14.

FIGS. 14-24 show a second embodiment of the apparatus of the present invention, designated generally by the numeral 60. Fluids management apparatus 60 provides an operations reservoir 61 and resupply reservoir 62. Operations reservoir 61 has a platform deck 63 and provides a docking station 64 that is receptive of resupply reservoir 62 as shown, for example, in FIG. 16. Walkway 65 is a part of platform deck 63 that surrounds docking station 64. Railing 66 can be provided at the periphery of walkway 65 as shown in FIG. 14. A stairway 67 enables users to ascend to platform deck 63.

Figure 20:
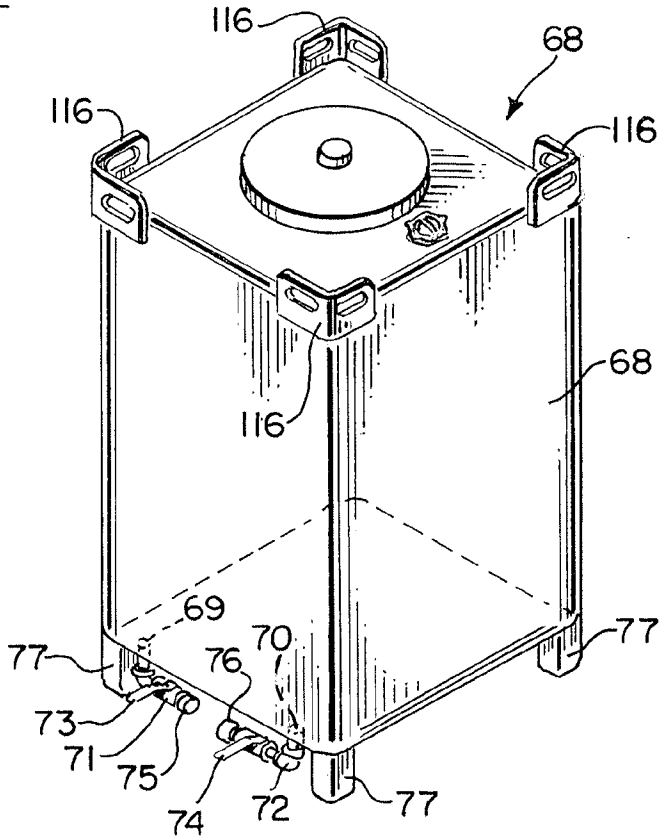
FIG. 20 is a partial perspective view of the second embodiment of the apparatus of the present invention.
Figure 18:
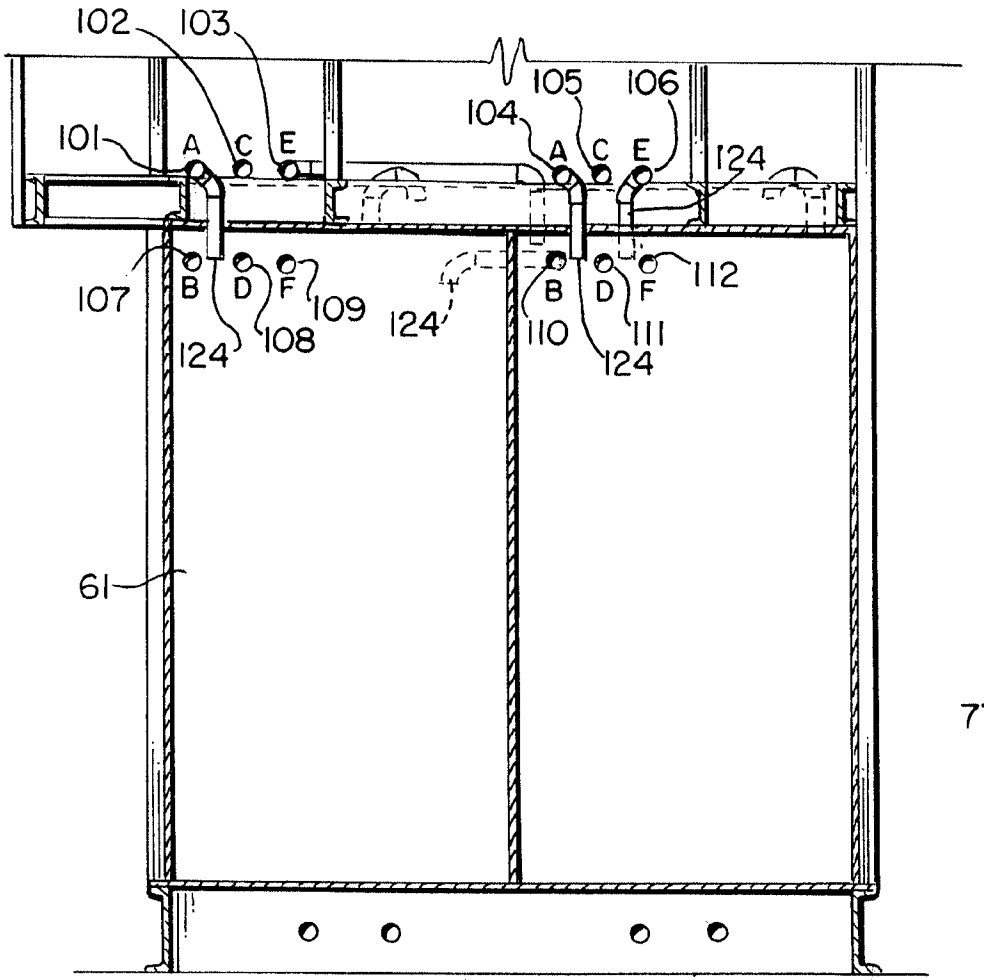
FIG. 18 is a sectional view taken along lines 18-18 of FIG. 14.
Figure 19:
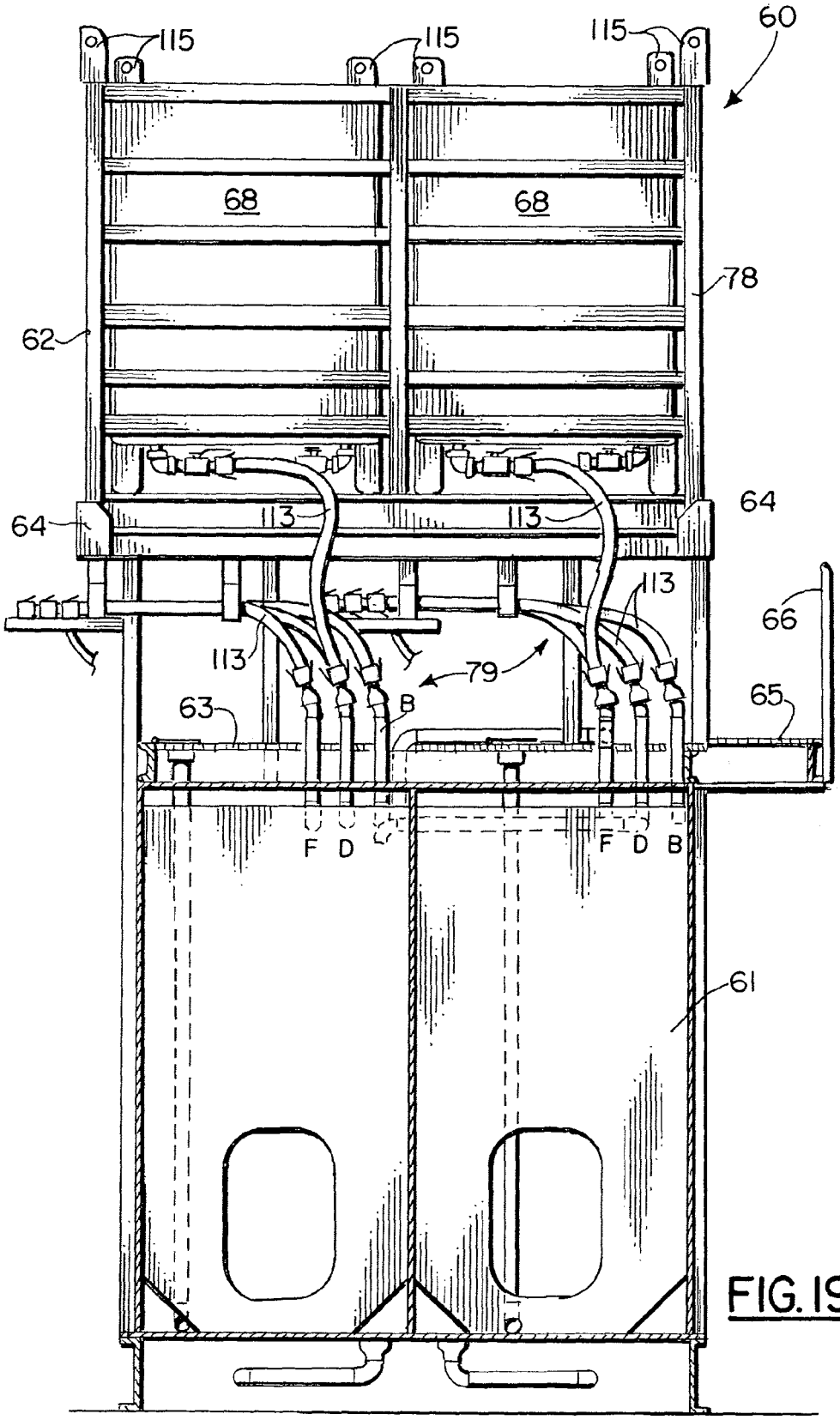
FIG. 19 is a sectional view taken along lines 19-19 of FIG. 14.
Figure 21:
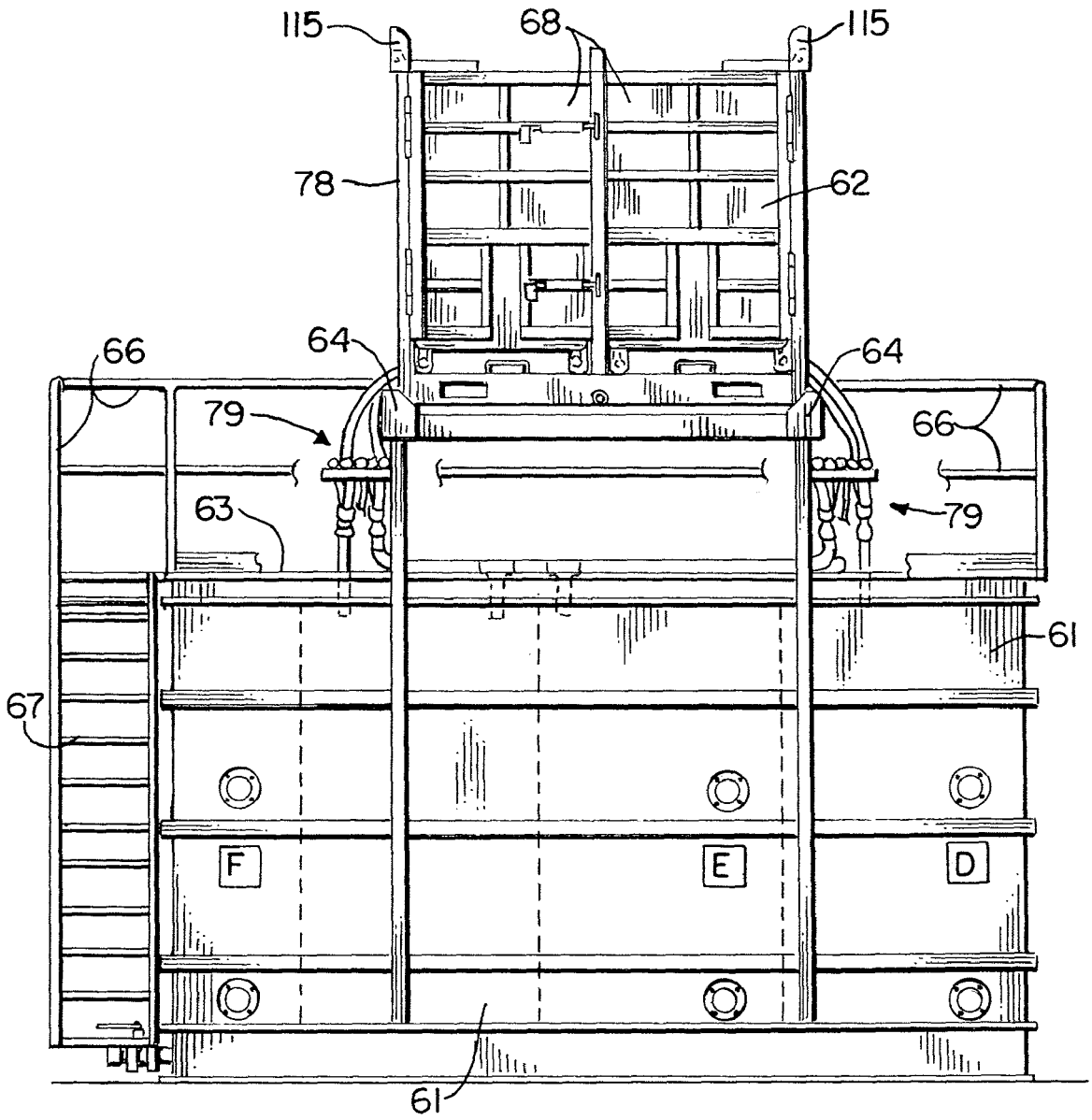
FIG. 21 is a sectional view taken along lines 21-21 of FIG. 14.
Figure 22:
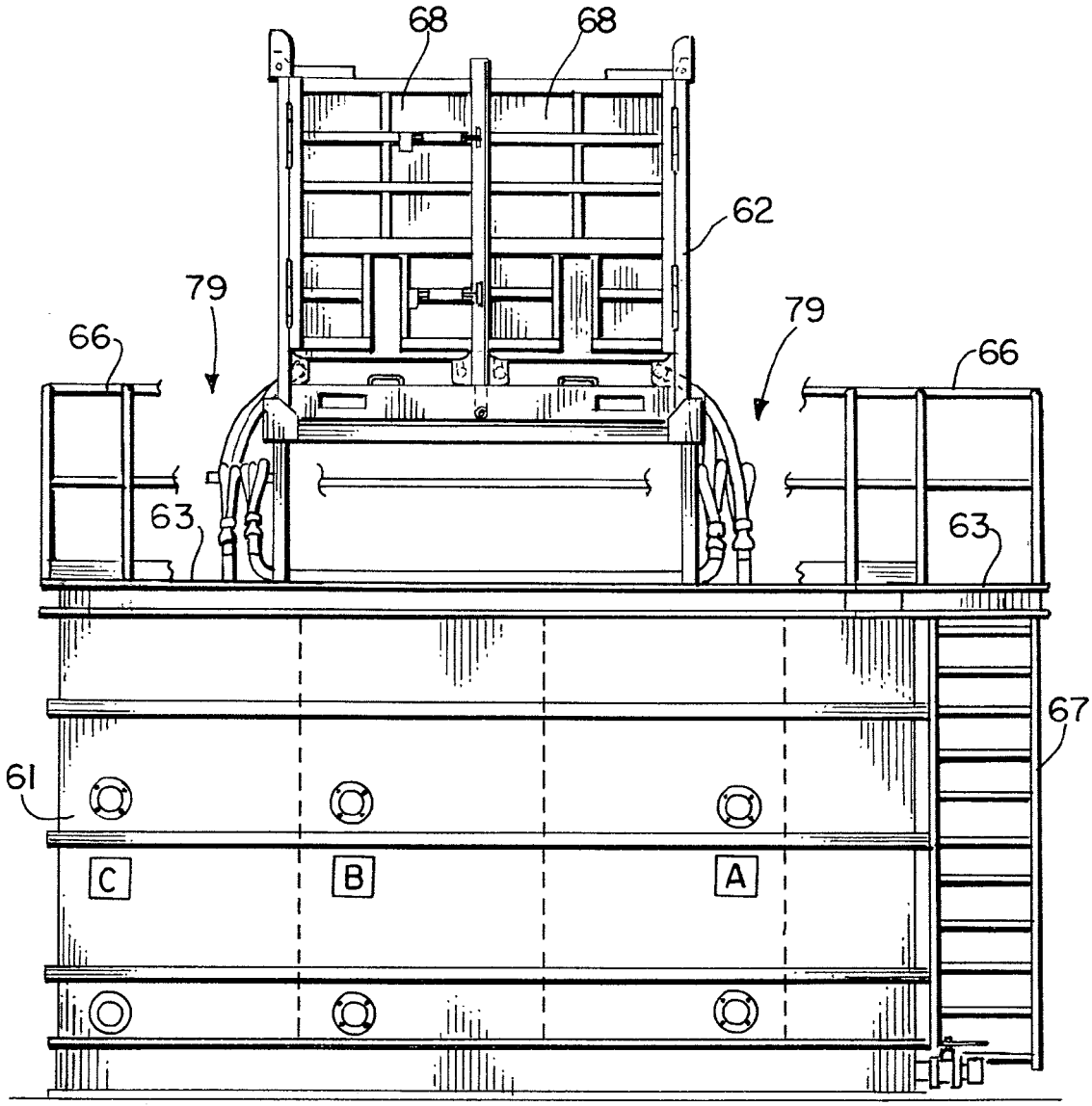
FIG. 22 is a sectional view taken along lines 22-22 of FIG. 14.

Resupply reservoir 62 carries a plurality of preferably four resupply tanks 68. Each resupply tank 68 has a pair of flow outlets 69, 70, each provided with a spool piece that can include a valve. In FIG. 20, flow outlet 69 communicates with spool piece 71 that includes valve 73. Spool piece 71 also provides a hose coupling fitting 75 for attaching a flow conveying hose to the spool piece 71 at hose coupling fitting 75. Similarly, spool piece 72 provides valve 74 and hose coupling fitting 76. The resupply tank 68 can have a plurality of feet 77. The plurality of resupply tank 68 are contained within resupply reservoir frame 78.

Figure 23:
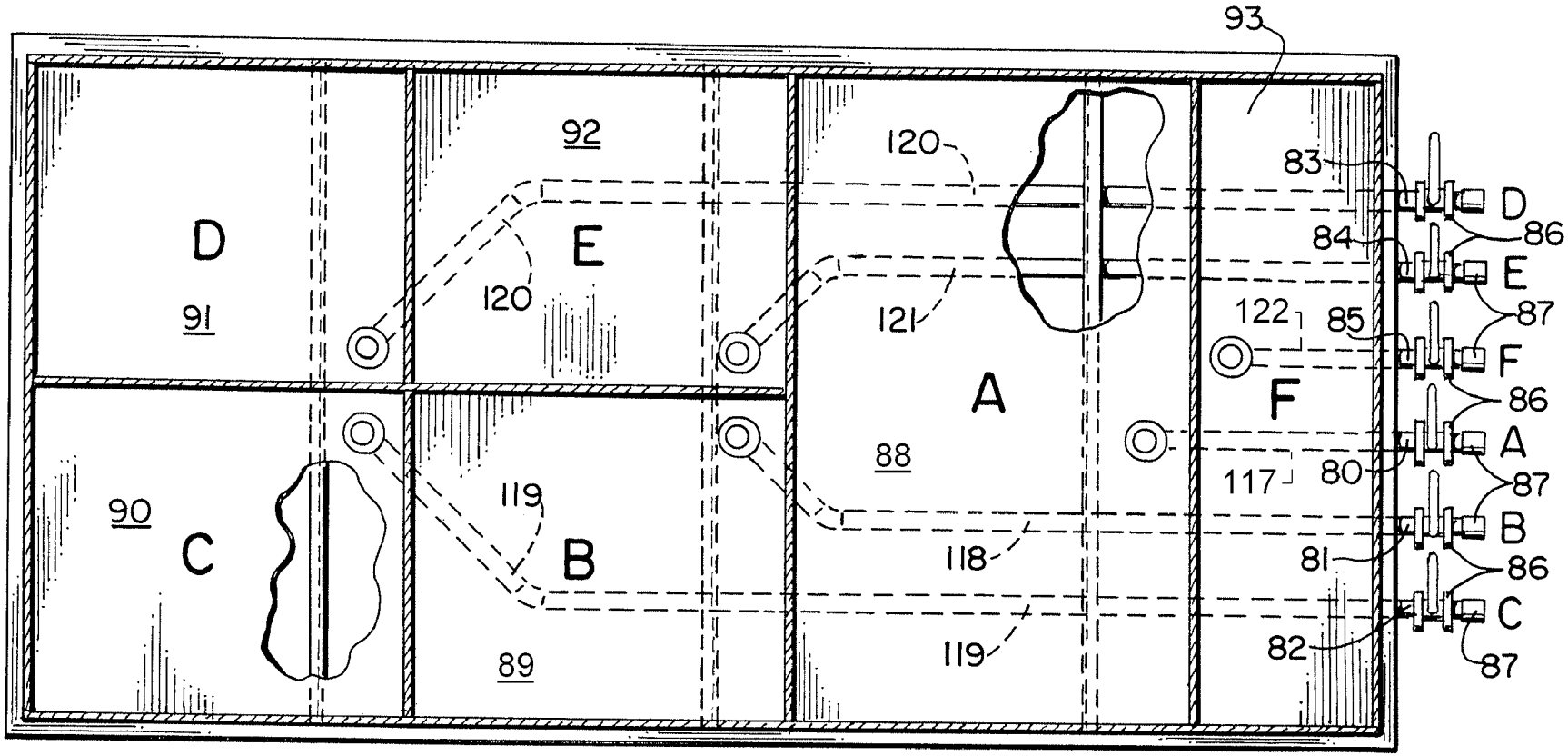
FIG. 23 is a partial, cutaway view of the second embodiment of the apparatus of the present invention.
Figure 24:
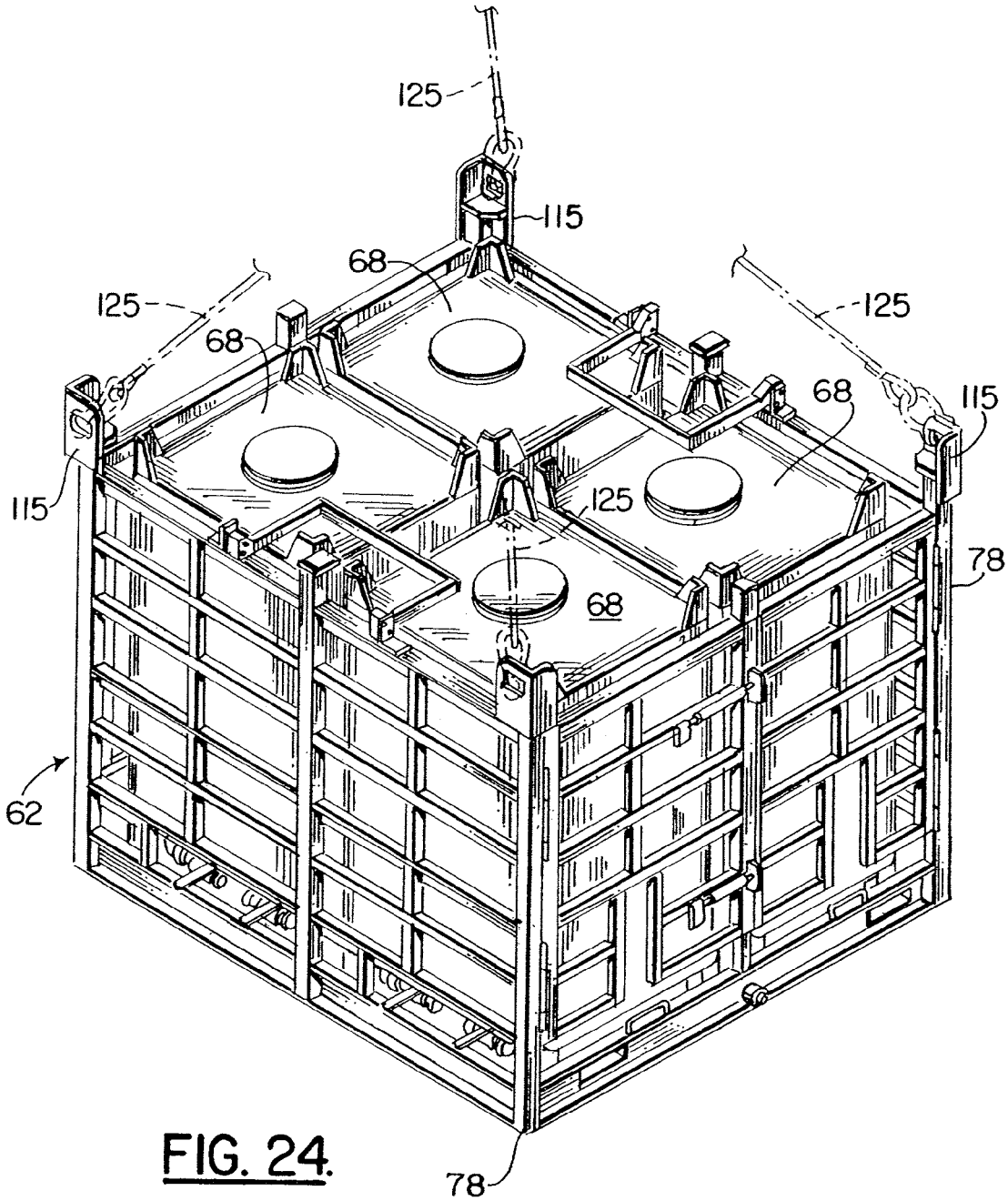
FIG. 24 is a partial perspective view of the second embodiment of the apparatus of the present invention.
Figure 25:
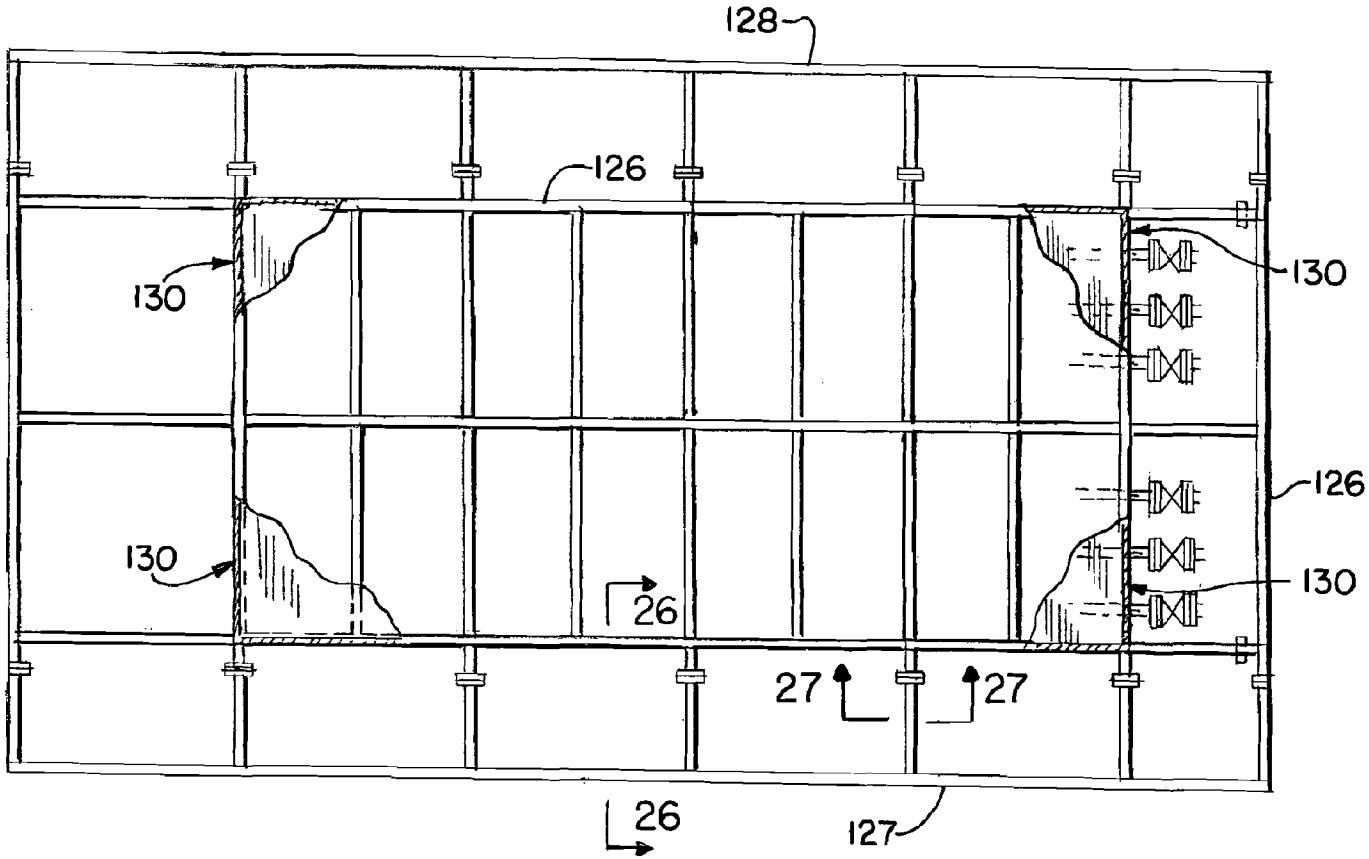
FIG. 25 is a partial plan view of the preferred embodiment of the apparatus of the present invention.
Figure 26:
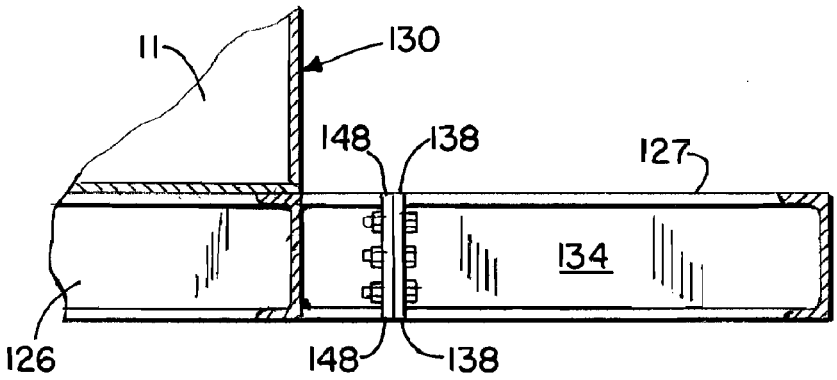
FIG. 26 is a sectional view taken along lines 26-26 of FIG. 25.
Figure 27:
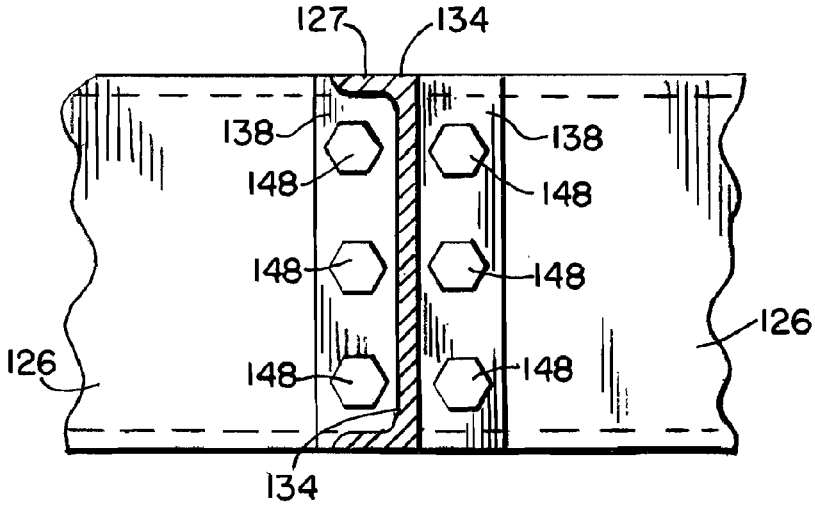
FIG. 27 is a sectional view taken along lines 27-27 of FIG. 25.

Piping system 79 (FIGS. 14, 15, 16, 17, 18 and 21-22) is used to transfer a selected fluid contained in a selected resupply tank 68 to any one of a plurality of selected storage tanks 88, 89, 90, 91, 92, 93 (see FIG. 23). Each storage tank 88-93 has a storage reservoir outlet. In the drawings, the tank 88 has reservoir outlet 80. The storage tank 89 has reservoir outlet 81. Similarly, storage tanks 90, 91, 92, 93 communicate respectively with storage reservoir outlets 82, 83, 84, 85. Each of the storage reservoir outlets 80-85 can provide a valve 86 and an outlet fitting 87.

Labels 94 can be placed above the outlets 80-85 or in a selected location next to the selected storage tank 88-93 to identify the contents of the storage tank 88-93. Each storage tank 88-93 provides a man-way for enabling access to the storage tank interior. In FIG. 14, tank 88 has man-way 95. Tank 89 has man-way 96. Similarly, the tanks 90, 91, 92, 93 provide respective man-way openings 97, 98, 99, 100.

The piping system 79 provides a plurality of upper level flow lines 101-106. The piping system 79 also provides a plurality of lower level flow lines 107-112. These flow lines 101-112 enable a selected fluid contained in any selected resupply tank 68 to be added to any selected storage tank 88-93. By providing the two spool pieces 71, 72 and related fittings to each supply tank 68, this fluid transfer can be effective notwithstanding the orientation of a storage tank 68 when it is placed in resupply reservoir frame 78. A flexible hose 113 can be coupled to a selected spool piece 71 or 72 or a selected resupply tank 68. That flexible hose 113 can also be connected to any one of the flow lines 101-112 depending upon the storage tank 88-93 that is to be re-supplied with fluid. Each flow line section 101-112 has preferably two (2) inlets 123 for receiving fluid via a hose 113 from a resupply tank 68. Each flow line section 101-112 has at least one discharge 124 for discharging fluid to a selected one of the storage tanks 87-93.

Resupply reservoir frame 78 can be lifted using a crane that is rigged using slings 125 for example to the plurality of lifting eyes 115 at the upper end portion of resupply reservoir frame 78. Each resupply tank 68 has a plurality of lifting eyes 116 enabling each individual resupply tank 68 to be lifted using a crane or other lifting device that is rigged to the lifting eyes 116.

A plurality of discharge flow lines 117, 118, 119, 120, 121, 122 are provided for discharging fluid from a selected respective storage tank 88, 89, 90, 91, 92, 93.

FIGS. 25-29 illustrate a specially configured base upon which reservoir 11 can be rested for load transfer between the liquids contained in reservoir 11 (and any docked supply reservoir) and a platform or rig.

Base 126 employs base extensions 127, 128 that are removably connectable to base 126 prior to use. The extensions 127, 128 can be removed to facilitate transport to or from a well drilling site, platform, rig or the like. Once added to base 126, extensions 127, 128 form with base 126 a structural under support that helps reduce load bearing per unit area (e.g. square foot) by forming a new base periphery 149 that is larger than the reservoir periphery 130.

Figure 28:
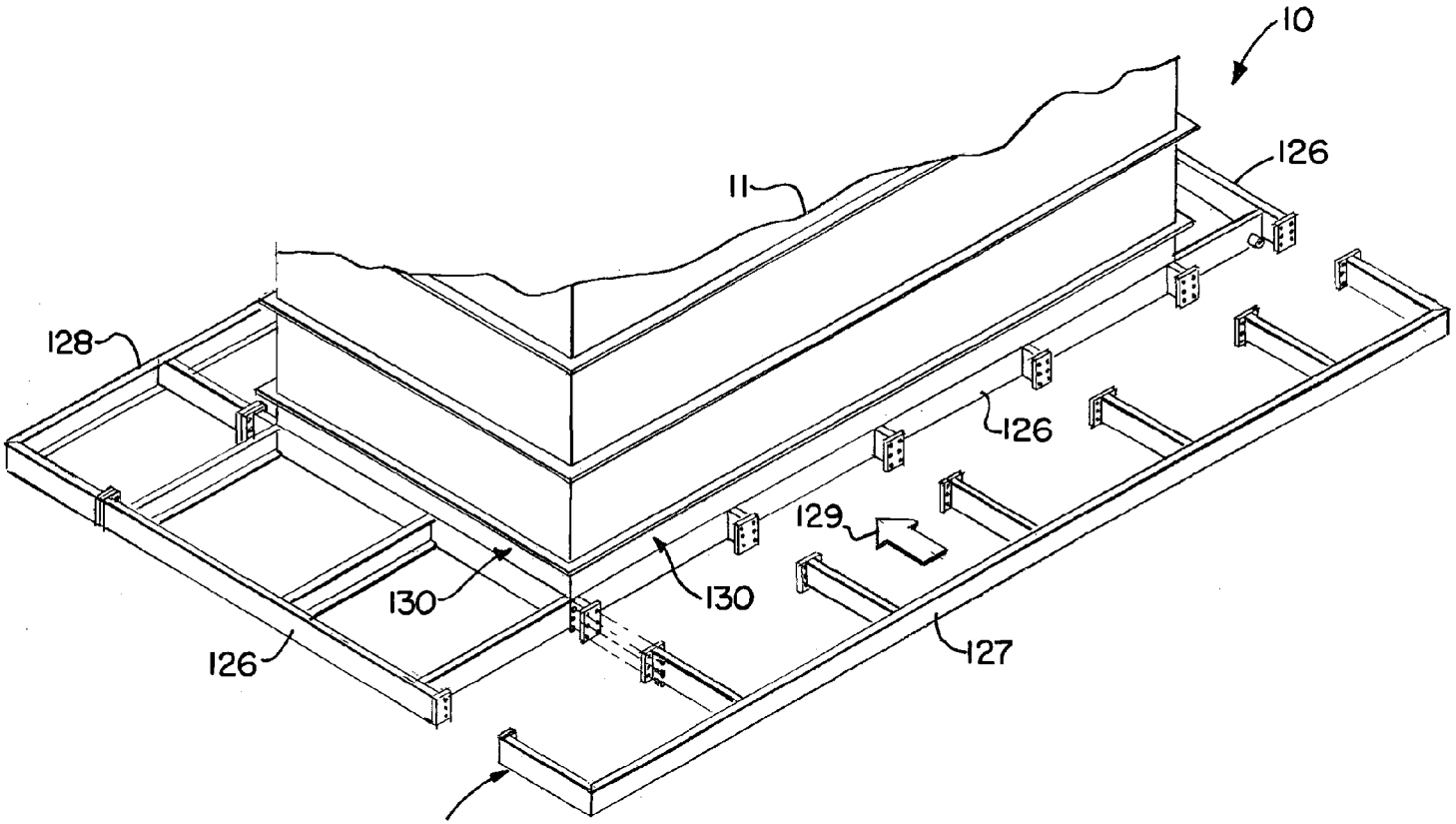
FIG. 28 is a partial perspective view of the preferred embodiment of the apparatus of the present invention.
Figure 29:
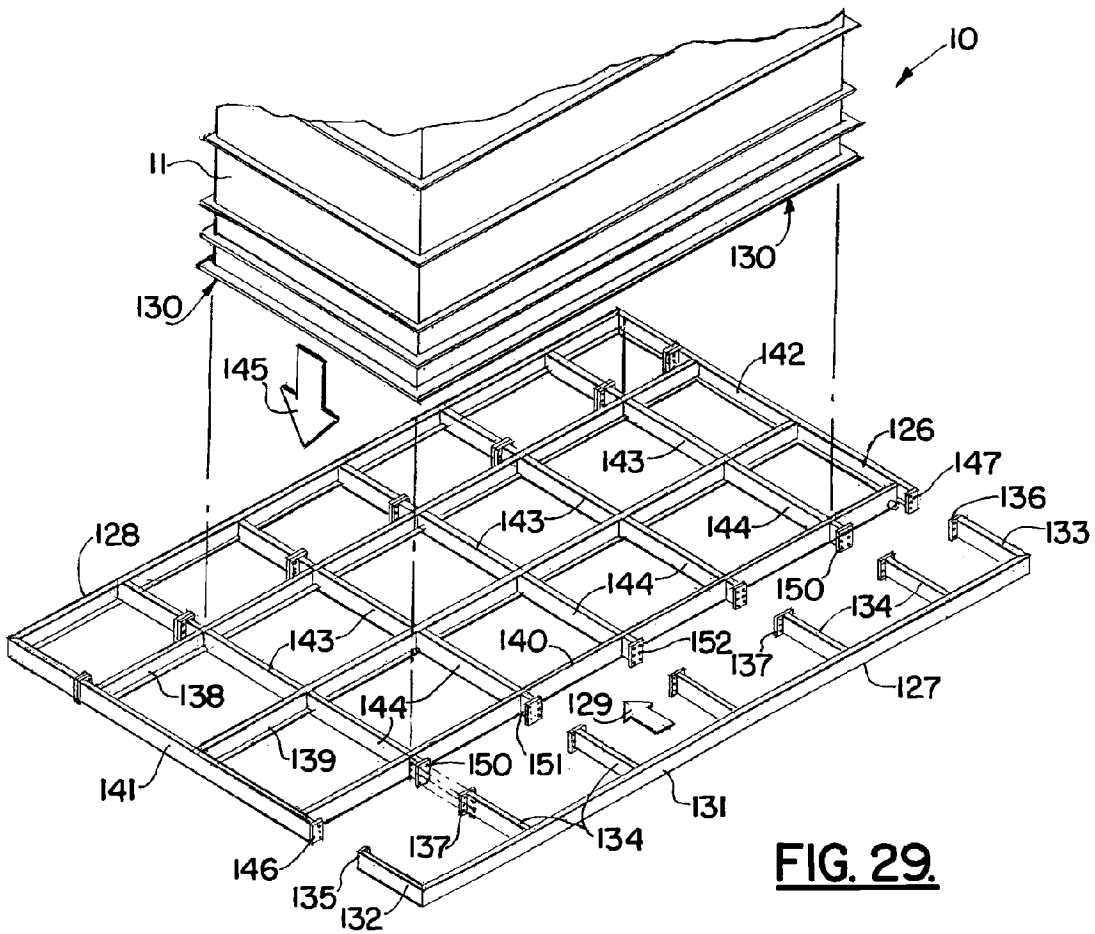
FIG. 29 is a partial perspective view of the preferred embodiment of the apparatus of the present invention.

Arrow 129 in FIG. 28 illustrates the addition of a base extension 127 to base 126. Bolted connections 148 can be used to secure each extension 127, 128 to base 126.

Each extension 127, 128 comprises at least one elongated longitudinal beam 131 and multiple transverse beams 132, 133, 134. Each transverse beam is fitted with a plate having plate openings 150 that are receptive of bolted connections 148. End beam 132 has plate 135. End beam 133 has plate 136. Beams 134 each have a plate 137.

Base 126 includes multiple longitudinal beams 138, 139, 140 that are connected together with transverse beams 141, 142, 143, 144 to provide therewith a generally rectangular, welded beam network. Base 126 can have a periphery that is equal to or larger than the periphery 130 of reservoir 11.

Arrow 145 illustrates the placement of reservoir 11 on base 126. Base extensions 127, 128 can then be bolted to base 126 using bolted connections 148. Each end beam 141, 142 has a plate that has plate openings 150. End beam 141 has a plate 146 at each of its ends. Likewise, beam 142 has plates 147 at each of its ends. Each short beam 151 has a plate 152. Upon assembly of an extension 127 or 128 to base 126, plates 135 and 146 are placed together face to face wherein the openings 150 of the plates 135, 146 align so that they can be bolted together using bolted connections 148. In like fashion, plates 137 and 152 are aligned face to face to be bolted together as shown.

The following is a list of parts and materials suitable for use in the present invention.

PARTS LIST

| Part Number | Description |
|---|---|
| 10 | fluids management apparatus |
| 11 | storage reservoir |
| 12 | resupply reservoir |
| 13 | platform deck |
| 14 | docking station |
| 15 | walkway |
| 16 | railing |
| 17 | stairway |
| 18 | resupply tank |
| 19 | flow outlet |
| 20 | spool piece |
| 21 | valve |
| 22 | hose coupling fitting |
| 23 | foot |
| 24 | resupply reservoir frame |
| 25 | piping system |
| 26 | storage reservoir outlet |
| 27 | storage reservoir outlet |
| 28 | storage reservoir outlet |
| 29 | storage reservoir outlet |
| 30 | storage reservoir outlet |
| 31 | storage reservoir outlet |
| 32 | valve |
| 33 | discharge flow line |
| 34 | storage tank |
| 35 | storage tank |
| 36 | storage tank |
| 37 | storage tank |
| 38 | storage tank |
| 39 | storage tank |
| 40 | label |
| 41 | man-way |
| 42 | man-way |
| 43 | man-way |
| 44 | man-way |
| 45 | man-way |
| 46 | man-way |
| 47 | flow line |
| 48 | flow line |
| 49 | flow line |
| 50 | flow line |
| 51 | flow line |
| 52 | flow line |
| 60 | fluids management apparatus |
| 61 | storage reservoir |
| 62 | resupply reservoir |
| 63 | platform deck |
| 64 | docking station |

-continued

| Part Number | Description |
|---|---|
| 65 | walkway |
| 66 | railing |
| 67 | stairway |
| 68 | resupply tank |
| 69 | flow outlet |
| 70 | flow outlet |
| 71 | spool piece |
| 72 | spool piece |
| 73 | valve |
| 74 | valve |
| 75 | hose coupling fitting |
| 76 | hose coupling fitting |
| 77 | foot |
| 78 | resupply reservoir frame |
| 79 | piping system |
| 80 | storage reservoir outlet |
| 81 | storage reservoir outlet |
| 82 | storage reservoir outlet |
| 83 | storage reservoir outlet |
| 84 | storage reservoir outlet |
| 85 | storage reservoir outlet |
| 86 | valve |
| 87 | outlet fitting |
| 88 | storage tank |
| 89 | storage tank |
| 90 | storage tank |
| 91 | storage tank |
| 92 | storage tank |
| 93 | storage tank |
| 94 | label |
| 95 | man-way |
| 96 | man-way |
| 97 | man-way |
| 98 | man-way |
| 99 | man-way |
| 100 | man-way |
| 101 | upper level flow line |
| 102 | upper level flow line |
| 103 | upper level flow line |
| 104 | upper level flow line |
| 105 | upper level flow line |
| 106 | upper level flow line |
| 107 | lower level flow line |
| 108 | lower level flow line |
| 109 | lower level flow line |
| 110 | lower level flow line |
| 111 | lower level flow line |
| 112 | lower level flow line |
| 113 | flexible hose |
| 114 | hose coupling fitting |
| 115 | lifting eye |
| 116 | lifting eye |
| 117 | discharge flow line |
| 118 | discharge flow line |
| 119 | discharge flow line |
| 120 | discharge flow line |
| 121 | discharge flow line |
| 122 | discharge flow line |
| 123 | flow line section inlet |
| 124 | flow line section discharge |
| 125 | lifting sling |
| 126 | base |
| 127 | base extension |
| 128 | base extension |
| 129 | arrow |
| 130 | reservoir periphery |
| 131 | elongated longitudinal beam |
| 132 | transverse end beam |
| 133 | transverse end beam |
| 134 | transverse beam |
| 135 | plate |
| 136 | plate |
| 137 | plate |
| 138 | longitudinal beam |
| 139 | longitudinal beam |
| 140 | longitudinal beam |
| 141 | transverse end beam |

-continued

| Part Number | Description |
|---|---|
| 142 | transverse end beam |
| 143 | transverse beam |
| 144 | transverse beam |
| 145 | arrow |
| 146 | plate |
| 147 | plate |
| 148 | bolted connection |
| 149 | base periphery |
| 150 | plate opening |
| 151 | short beam |
| 152 | plate |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A fluids management apparatus for managing multiple, different fluids on an oil and gas well drilling platform, comprising:

a) a structural, transportable frame having a base with a footprint surrounded by a perimeter, the base having a lower surface;

b) a lower reservoir section on the frame having a plurality of storage reservoirs for holding multiple, separate fluids;

c) a plurality of flow outlets for discharging a selected fluid from a selected reservoir;

d) an upper reservoir section that comprises a transportable crane liftable unit;

e) a docking station on the frame above lower reservoir section that is configured to receive the upper reservoir section, the upper reservoir section having a plurality of supply reservoirs;

f) piping that enables a selected of the supply reservoirs to transfer its contents to a selected of the storage reservoirs; and g) at least one removable frame that is attachable to the base at the periphery and that has a lower surface that effects load transfer generally coplanar with the lower surface of the base.

2. The fluids management apparatus of claim 1 wherein there are at least three storage reservoirs.

3. The fluids management apparatus of claim 1 wherein there are between 4 and 6 storage reservoirs.

4. The fluids management apparatus of claim 1 wherein at least one of the supply reservoirs is smaller than one of the storage reservoirs.

5. The fluids management apparatus of claim 1 wherein all of the supply reservoirs are smaller than each storage reservoir.

6. The fluids management apparatus of claim 1 wherein the frame has multiple sides, and all of the flow outlets are positioned on the same side of the frame.

7. The fluids management apparatus of claim 1 wherein all of the flow outlets are positioned next to each other.

8. The fluids management apparatus of claim 1 wherein each supply reservoir has a supply reservoir outlet and the piping includes a plurality of flow lines, each connectable to a supply reservoir outlet.

9. The fluids management apparatus of claim 8 wherein each storage reservoir has a flow inlet and the piping includes multiple flow lines that enable flow to be directed to a selected storage reservoir from a selected supply reservoir.

10. The fluids management apparatus of claim 1 wherein the frame has a walkway that is next to the docking station.

11. The fluids management apparatus of claim 10 further comprising a stairway that provides access to the walkway.

12. A fluids management apparatus for managing multiple, different fluids in an oil and gas well drilling platform, comprising;

a) a structural, transportable frame having a base with a lower load transfer bearing surface and a periphery;

b) a lower tank section on the frame having a plurality of storage tanks for holding multiple, separate fluids;

c) a plurality of flow outlets for discharging a selected fluid from a selected tank;

d) an upper tank section that comprises a transportable crane liftable unit;

e) a docking station on the frame above lower tank section that is configured to receive the upper tank section, the upper tank section having a plurality of supply tanks;

f) piping that enables a selected of the supply tanks to transfer its contents to a selected of the storage tanks; and g) one or more generally rectangular structural frames that are affixable to the base at the periphery, each frame having a lower surface that is a load transfer bearing surface.

13. The fluids management apparatus of claim 12 wherein there are at least three storage tanks.

14. The fluids management apparatus of claim 12 wherein there are between 4 and 6 storage tanks.

15. The fluids management apparatus of claim 12 wherein at least one of the supply tanks is smaller than one of the storage tanks.

16. The fluids management apparatus of claim 12 wherein all of the supply tanks are smaller than each storage tank.

17. The fluids management apparatus of claim 12 wherein the frame has multiple sides, and all of the flow outlets are positioned on the same side of the frame.

18. The fluids management apparatus of claim 12 wherein all of the flow outlets are positioned next to each other.

19. The fluids management apparatus of claim 12 wherein each supply tank has a supply tank outlet and the piping includes a plurality of flow lines, each connectable to a supply tank outlet.

20. The fluids management apparatus of claim 18 wherein each storage tank has a flow inlet and the piping includes multiple flow lines that enable flow to be directed to a selected storage tank from a selected supply tank.

21. The fluids management apparatus of claim 12 wherein the frame has a walkway that is next to the docking station.

22. The fluids management apparatus of claim 21 further comprising a stairway that provides access to the walkway.

23. A fluids management apparatus for managing multiple, different fluids in an oil and gas well drilling platform, comprising:

a) a structural, transportable frame that includes a generally rectangular structural base of a plurality of beams, the base having a lower bearing surface and a periphery;

b) a lower reservoir section on the frame having a plurality of storage reservoirs for holding multiple, separate fluids;

c) a plurality of flow outlets for discharging a selected fluid from a selected reservoir;

d) an upper reservoir section that comprises a transportable crane liftable unit;

e) a docking station on the frame above lower reservoir section that is configured to receive the upper reservoir section, the upper reservoir section having a plurality of supply reservoirs;

f) a piping system that includes multiple flow lines, at least one flow line communicating with each storage reservoir, and each flow line having a plurality of connectable and disconnectable fittings that enable a selected flow line to transfer the contents of a selected supply reservoir to a selected storage reservoir; and g) multiple structural frames that are connectable to the base to increase the size and shape of the rectangular base at a side of the base and at an end of the base.

* * * * *